US010269375B2

(12) United States Patent
Arsikere et al.

(10) Patent No.: US 10,269,375 B2
(45) Date of Patent: Apr. 23, 2019

(54) METHODS AND SYSTEMS FOR CLASSIFYING AUDIO SEGMENTS OF AN AUDIO SIGNAL

(71) Applicant: Conduent Business Services, LLC, Dallas, TX (US)

(72) Inventors: Harish Arsikere, Bangalore (IN); Arunasish Sen, Kolkata (IN); Prathosh Aragulla Prasad, Mysore (IN)

(73) Assignee: CONDUENT BUSINESS SERVICES, LLC, Dallas, TX (US)

( * ) Notice: Subject to any disclaimer, the term of this patent is extended or adjusted under 35 U.S.C. 154(b) by 106 days.

(21) Appl. No.: 15/135,671

(22) Filed: Apr. 22, 2016

(65) Prior Publication Data

US 2017/0309297 A1 Oct. 26, 2017

(51) Int. Cl.

| | |
|---|---|
| ***G10L 25/18*** | (2013.01) |
| ***G10L 25/87*** | (2013.01) |
| ***G10L 25/51*** | (2013.01) |
| ***G10L 25/90*** | (2013.01) |
| ***G10L 25/93*** | (2013.01) |
| ***G10L 25/21*** | (2013.01) |

(52) U.S. Cl.

CPC ..... *G10L 25/51* (2013.01); *G10L 25/18* (2013.01); *G10L 25/21* (2013.01); *G10L 25/87* (2013.01); *G10L 25/90* (2013.01); *G10L 25/93* (2013.01); *G10L 2025/932* (2013.01); *G10L 2025/937* (2013.01)

(58) Field of Classification Search

CPC ..... G10L 21/028; G10L 25/18
USPC ..... 704/205, 208, 215, 218
See application file for complete search history.

(56) References Cited

U.S. PATENT DOCUMENTS 5,995,924 A 11/1999 Terry
6,490,556 B1 * 12/2002 Graumann ..... G10L 25/78 704/215
6,707,910 B1 * 3/2004 Valve ..... G10L 25/78 342/423

(Continued)

OTHER PUBLICATIONS

K. Boakye, B. Favre, and D. Hakkani-T ür, "Any questions? Automatic question detection in meetings," in Proceedings of the IEEE Workshop on Automatic Speech Recognition and Understanding, 2009, pp. 485-489.

(Continued)

*Primary Examiner* — Michael N Opsasnick
(74) *Attorney, Agent, or Firm* — Jones Robb, PLLC

(57) ABSTRACT

The disclosed embodiments illustrate a method for classifying one or more audio segments of an audio signal. The method includes determining one or more first features of a first audio segment of the one or more audio segments. The method further includes determining one or more second features based on the one or more first features. The method includes determining one or more third features of the first audio segment, wherein each of the one or more third features is determined based on a second feature of the one or more second features of the first audio segment and at least one second feature associated with a second audio segment. Additionally, the method includes classifying the first audio segment either in an interrogative category or a non-interrogative category based on one or more of the one or more second features and the one or more third features.

16 Claims, 9 Drawing Sheets

(56) References Cited

U.S. PATENT DOCUMENTS

| | | | | |
|---|---|---|---|---|
| 6,775,653 | B1 * | 8/2004 | Wei | H04B 3/23 379/406.01 |
| 7,996,214 | B2 | 8/2011 | Bangalore et al. | |
| 2001/0016817 | A1 * | 8/2001 | Dejaco | G10L 19/12 704/264 |
| 2001/0018650 | A1 * | 8/2001 | DeJaco | G10L 19/18 704/200.1 |
| 2002/0007269 | A1 * | 1/2002 | Gao | G10L 19/10 704/212 |
| 2002/0049585 | A1 * | 4/2002 | Gao | G10L 19/18 704/220 |
| 2002/0198713 | A1 * | 12/2002 | Franz | G10L 15/26 704/252 |
| 2005/0182620 | A1 * | 8/2005 | Kabi | G10L 25/78 704/216 |
| 2008/0002669 | A1 * | 1/2008 | O'Brien | H04L 12/66 370/352 |
| 2009/0006085 | A1 | 1/2009 | Horvitz et al. | |
| 2010/0235166 | A1 * | 9/2010 | Bardino | G10L 21/04 704/207 |
| 2011/0016077 | A1 * | 1/2011 | Vasilache | G10L 25/78 706/52 |
| 2011/0029308 | A1 * | 2/2011 | Konchitsky | G10L 25/78 704/233 |
| 2012/0014514 | A1 * | 1/2012 | Enbom | H04M 3/18 379/32.01 |
| 2013/0073285 | A1 * | 3/2013 | Hetherington | G10L 25/78 704/233 |

OTHER PUBLICATIONS

A. Margolis and M. Ostendorf, "Question detection in spoken conversations using textual conversations," in Proceedings of the 49th Annual ACL Meeting on Human Language Technologies, 2011, pp. 118-124.

E. Frank, M. Hall, G. Holmes, R. Kirkby, B. Pfahringer, I. H. Witten, and L. Trigg, "Weka," in Data Mining and Knowledge Discovery Handbook, 2005, pp. 1305-1314.

S. Ananthakrishnan, P. Ghosh, and S. Narayanan, "Automatic classification of question turns in spontaneous speech using lexical and prosodic evidence," in Proceedings of ICASSP, 2008, pp. 5005-5008.

V. M. Quang, L. Besacier, and E. Castelli, "Automatic question detection: prosodic-lexical features and cross-lingual experiments," in Proceedings of Interspeech, 2007, pp. 2257-2260.

E. Shriberg, A. Stolcke, D. Jurafsky, N. Coccaro, M. Meteer, R. Bates, P. Taylor, K. Ries, R. Martin, and C. VanEss-Dykema, "Can prosody aid the automatic classification of dialog acts in conversational speech?" Language and Speech, vol. 41, pp. 443-492, 1998.

V. Rangarajan, S. Bangalore, and S. Narayanan, "Exploiting prosodic features for dialog act tagging in a discriminative modeling framework," in Proceedings of Interspeech, 2007.

* cited by examiner

METHODS AND SYSTEMS FOR CLASSIFYING AUDIO SEGMENTS OF AN AUDIO SIGNAL

TECHNICAL FIELD

The presently disclosed embodiments are related, in general, to audio signal processing. More particularly, the presently disclosed embodiments are related to methods and systems for classifying audio segments of an audio signal.

BACKGROUND

Expansion of wired and wireless networks has enabled an entity, such as a customer, to communicate with other entities, such as a customer care representative, over wired or wireless networks. For example, the customer care representative in a call center or a commercial organization, may communicate with the customers, or other individuals, to recommend new services/products or to provide a technical support on existing services/products.

The communication between the entities may be a voiced conversation that may involve communication of a speech signal (generated by respective entities involved in the communication) between the entities. Usually, the communication comprises a dialogue act between the entities involved in the communication. Usually, the dialogue act between the entities, such as a customer and a customer care representative, may correspond to an interrogative dialogue in which the customer may have certain queries for the customer care representative and the customer care representative may in return provide responses for the queries. Therefore, a classification of the dialogue act into one or more categories may be essential. Such classification may allow an organization or a service provider to derive one or more inferences pertaining to the dialogue act that may further be utilized to improve upon one or more existing services. For example, an organization may determine how efficiently a customer care representative has answered a query of a customer. However, the process of classifying such dialogue act may be a cumbersome process.

Further limitations and disadvantages of conventional and traditional approaches will become apparent to one of skill in the art, through comparison of described systems with some aspects of the present disclosure, as set forth in the remainder of the present application and with reference to the drawings.

SUMMARY

According to embodiments illustrated herein there is provided a method of classification of one or more audio segments of an audio content. The method includes determining one or more first features associated with a first audio segment of the one or more audio segments based on one or more speech processing techniques, wherein the first audio segment comprises an uninterrupted audio of a user. The method further includes determining one or more second features associated with the first audio segment based on the one or more first features of the first audio segment. The method further includes determining one or more third features of the first audio segment, wherein a third feature in the one or more third features is determined based on a second feature of the one or more second features of the first audio segment and at least one second feature associated with a second audio segment, wherein the second audio segment corresponds to temporally adjacent audio segment to the first audio segment. Additionally, the method includes classifying the first audio segment either in an interrogative category or a non-interrogative category based on one or more of the one or more second features and the one or more third features.

According to embodiments illustrated herein there is provided a system for classifying one or more audio segments of an audio content. The system includes one or more processors configured to determine, one or more first features associated with a first audio segment of the one or more audio segments based on one or more speech processing techniques, wherein the first audio segment comprises an uninterrupted audio of a user. The system further includes the one or more processors configured to determine, one or more second features associated with the first audio segment based on the one or more first features of the first audio segment. The system further includes the one or more processors configured to determine, one or more third features of the first audio segment, wherein a third feature in the one or more third features is determined based on a second feature of the one or more second features of the first audio segment and at least one second feature associated with a second audio segment, wherein the second audio segment corresponds to temporally adjacent audio segment to the first audio segment. Additionally, the system includes the one or more processors further configured to classify, the first audio segment either in an interrogative category or a non-interrogative category based on one or more of the one or more second features and the one or more third features.

According to embodiments illustrated herein there is provided a computer program product for use with a computer, the computer program product comprising a non-transitory computer readable medium, wherein the non-transitory computer readable medium stores a computer program code for classifying one or more audio segments of an audio content. The computer program code is executable by one or more processors to determine, one or more first features associated with a first audio segment of the one or more audio segments based on one or more speech processing techniques, wherein the first audio segment comprises an uninterrupted audio of a user. The computer program code is further executable by the one or more processors to determine, determine, one or more second features associated with the first audio segment based on the one or more first features of the first audio segment. The computer program code is executable by one or more processors to determine, one or more third features of the first audio segment, wherein a third feature in the one or more third features is determined based on a second feature of the one or more second features of the first audio segment and at least one second feature associated with a second audio segment, wherein the second audio segment corresponds to temporally adjacent audio segment to the first audio segment. Additionally, the computer program code is executable by the one or more processors to classify, the first audio segment either in an interrogative category or a non-interrogative category based on one or more of the one or more second features and the one or more third features.

BRIEF DESCRIPTION OF DRAWINGS

The accompanying drawings illustrate various embodiments of systems, methods, and other aspects of the disclosure. Any person having ordinary skill in the art will appreciate that the illustrated predetermined element boundaries (e.g., boxes, groups of boxes, or other shapes) in the figures represent one example of the boundaries. It may be that in some examples, one element may be designed as multiple elements or that multiple elements may be designed as one element. In some examples, an element shown as an internal component of one element may be implemented as an external component in another, and vice versa. Furthermore, elements may not be drawn to scale.

Various embodiments will hereinafter be described in accordance with the appended drawings, which are provided to illustrate, and not to limit the scope in any manner, wherein like designations denote similar elements, and in which.

DETAILED DESCRIPTION

Figure 1:
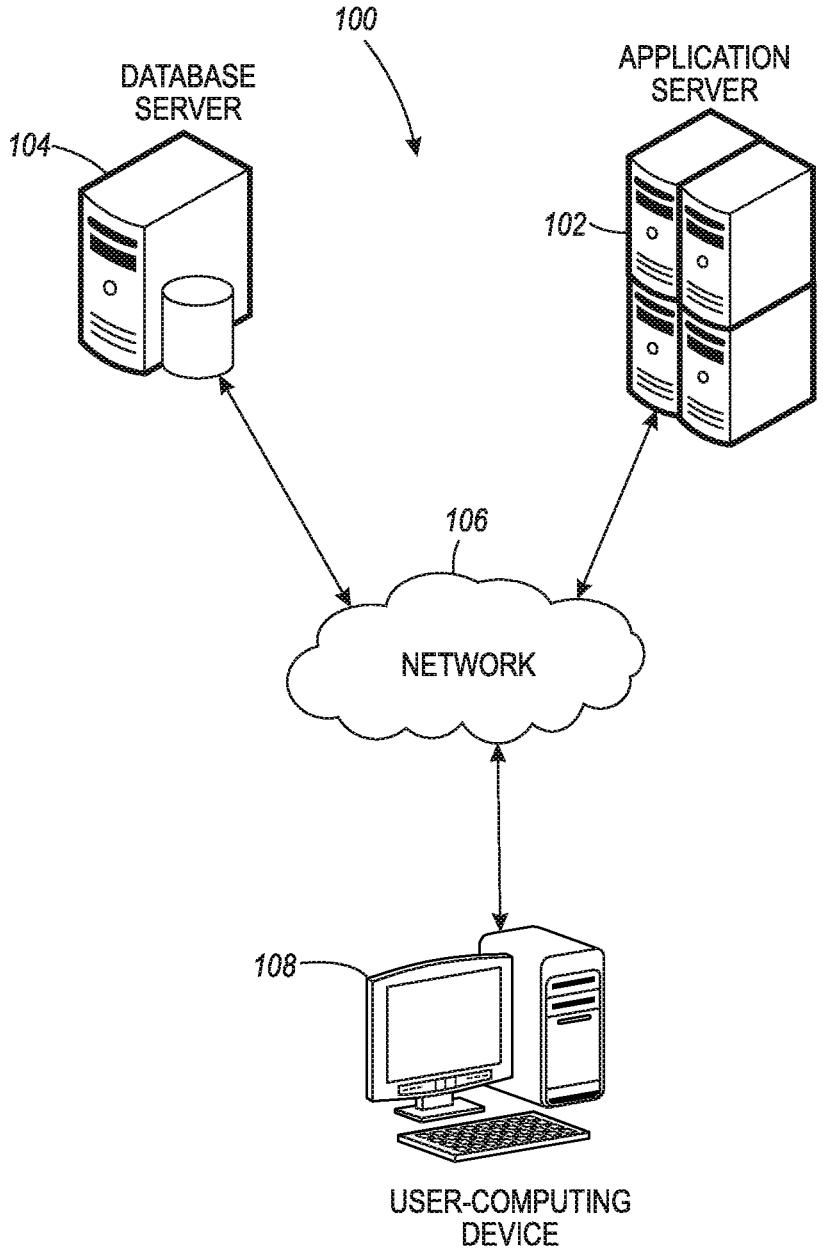
FIG. 1 is a block diagram illustrating a system environment in which various embodiments may be implemented.

The present disclosure is best understood with reference to the detailed figures and description set forth herein. Various embodiments are discussed below with reference to the figures. However, those skilled in the art will readily appreciate that the detailed descriptions given herein with respect to the figures are simply for explanatory purposes as the methods and systems may extend beyond the described embodiments. For example, the teachings presented and the needs of a particular application may yield multiple alternate and suitable approaches to implement the functionality of any detail described herein. Therefore, any approach may extend beyond the particular implementation choices in the following embodiments described and shown.

References to "one embodiment", "an embodiment", "at least one embodiment", "one example", "an example", "for example" and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in an embodiment" does not necessarily refer to the same embodiment.

Definitions

The following terms shall have, for the purposes of this application, the respective meanings set forth below.

An "audio signal" may refer to a representation of a sound. In an embodiment, the audio signal may refer to a speech signal of one or more users. In an embodiment, the audio signal may correspond to a speech conversation between the one or more users. In another embodiment, the audio signal may refer to a musical composition. In an embodiment, the audio signal may be recorded and played through an audio player such as windows media player, music player, etc., on a computing device. In an embodiment, the audio signal may be downloaded from a database server to the computing device. In an alternate embodiment, the audio signal may be stored on a storage device, such as Hard Disk Drive, CD Drive, Pen Drive, etc., connected to (or inbuilt within) the computing device.

"One or more audio segments" may refer to one or more samples of an audio signal such that each of the one or more samples comprises an uninterrupted audio of a user. In an embodiment, the audio signal may be segmented into the one or more audio segments by utilizing one or more segmentation techniques known in the art. In an embodiment, the one or more audio segments of an audio signal (e.g., a speech conversation between two users) may correspond to an audio segment comprising a continuous speech of the first user without being interrupted by a second user or an audio segment comprising a continuous speech of the second user without being interrupted by the first user. For example, Table 1 illustrates "5 minutes" long speech conversation between two users, i.e., user 1 and user 2.

TABLE 1

Illustration of the speech conversation and timestamps corresponding to the speech duration of the user 1 and the user 2 in the speech conversation

| User | Timestamp of the speech conversation (MM:SS) |
|---|---|
| User 1 | 00:00-01:04 |
| User 2 | 01:06-02:34 |
| User 1 | 02:36-04:12 |
| User 2 | 04:12-05:00 |

Referring to Table 1, time durations, such as 00:00-01:04 and 02:36-04:12, of the audio signal corresponds to the uninterrupted speech of the user 1, and time durations, such as (01:06-02:34 and 04:12-05:00), of the audio signal corresponds to the uninterrupted speech of the user 2. In an embodiment, the audio signal may be segmented into four audio segments (i.e., 00:00-01:04, 01:06-02:34, 02:36-04:12, and 04:12-05:00), such that each of the four audio segments comprises the uninterrupted speech of either the user 1 or the user 2. In this scenario, the four audio segments may correspond to the one or more audio segments of the audio signal.

"Speech processing techniques" may refer to one or more processing techniques that may be utilized to process/analyze an audio signal. In an embodiment, the speech processing techniques may be used to modify the audio signal for speech analysis. In another embodiment, the speech processing techniques may be performed on the audio signal to determine one or more features corresponding to the audio signal. Examples of the one speech processing techniques are a voiced/unvoiced classification, pitch tracking, speech activity detection, spectrogram computation, and/or the like.

"One or more audio frames" may refer to one or more frames of fixed duration determined from an audio signal. In an embodiment, the one or more audio frames may be generated from the audio signal by segmenting the audio signal into one or more audio frames. In an embodiment, the one or more audio frames may be generated from each of one or more audio segments of the audio signal. In an embodiment, the one or more audio frames are generated in such a manner that there is an overlap of a predetermined time period between two temporally adjacent audio frames. For example, a first audio frame starts from a timestamp 10 seconds of the audio signal and ends at 10.30 seconds. A second audio frame starts from a timestamp 10.10 seconds and ends at the timestamp 10.40 seconds. In this scenario, the first audio frame and the second audio frame have an overlap of 0.20 seconds. Further, the first audio frame and the second audio frame are spaced at 0.10 seconds. In an embodiment, the one or more audio frames may comprise a vowel sound, a consonant sound or noise (speech sounds). For example, Table 2 illustrates the one or more audio frames and a corresponding speech sound.

TABLE 2

Illustration of the one or more audio frames and corresponding speech sound

| One or more audio frames | Speech sound (erode –>ə rōd) |
|---|---|
| Frame 1 | ə (ə̲ rōd) |
| Frame 2 | r̲ (ə r̲ōd) |
| Frame 3 | ō (ə r̲ō̲d) |
| Frame 4 | d (ə rō̲d̲) |
| Frame 5 | — |
| Frame 6 | — |

Referring Table 2, frame 1 comprises a vowel sound (i.e., ə), frame 2 comprises a consonant sound (i.e., r), frame 3 comprises a vowel sound (i.e., 5), frame 4 comprises a consonant sound (i.e., d), and frame 5 and frame 6 do not comprise speech sound (i.e., silence).

"One or more voiced frames" may refer to one or more audio frames of an audio signal comprising speech vibrations produced by periodic excitations of vocal tract (glottal pulse). In an embodiment, if an audio frame comprises speech vibrations produced by quasi-periodic excitations along with the periodic excitations of the vocal tract, then the audio frame may also correspond to the one or more voiced frames. Further, the one or more voiced frames may refer to the one or more audio frames comprising a vowel sound. In an embodiment, the one or more voiced frames may be identified from the one or more audio frames of an audio segment of the audio signal. In an embodiment, a computing device may identify a voiced frame from one or more audio frames by applying a voiced/unvoiced classification technique on the one or more audio frames. For example, referring Table 2, frame 1 and frame 3 of the one or more audio frames comprise the vowel sound. Therefore, frame 1 and frame 3 may correspond to the one or more voiced frames.

"One or more unvoiced frames" may refer to one or more audio frames of an audio signal comprising speech vibrations produced by aperiodic excitations of vocal tract. Further, the one or more unvoiced frames may refer to the one or more audio frames comprising a consonant sound or noise. In an embodiment, a computing device may identify an unvoiced frame from the one or more audio frames by applying a voiced/unvoiced classification technique on the one or more audio frames. In an embodiment, the one or more unvoiced frames may be identified from the one or more audio frames of an audio segment of the audio signal. For example, referring Table 2, frame 2 and frame 4 of the one or more audio frames comprise the consonant sound. Therefore, frame 2 and frame 4 may correspond to the one or more unvoiced frames.

"One or more speech frames" may refer to one or more frames selected from one or more audio frames based on presence of a speech in an audio signal. In an embodiment, the speech may correspond to a human speech. In an embodiment, the one or more speech frames may be determined from the one or more audio frames of an audio signal based on one or more speech activity detection algorithms. In an embodiment, the one or more speech frames may be identified from the one or more audio frames of an audio segment of the audio signal. In an embodiment, the one or more speech frames may further comprise one or more voiced frames and one or more unvoiced frames. For example, referring Table 2, frame 1, frame 2, frame 3, and frame 4 of the one or more audio frames comprise either a vowel sound or a consonant sound (indicates presence of speech). Therefore, frame 1, frame 2, frame 3, and frame 4 may correspond to the one or more speech frames.

"One or more non-speech frames" may refer to one or more frames of an audio signal that may not include a speech. In an embodiment, the one or more audio frames comprising only a musical composition may also correspond to the one or more non-speech frames. In an embodiment, the one or more audio frames comprising either noise or silence may also correspond to the one or more non-speech frames. In another embodiment, the one or more non-speech frames may be identified from the one or more audio frames of an audio segment of the audio signal. For example, referring Table 2, frame 5, and frame 6 of the one or more audio frames do not comprise any speech (indicates silence or noise). Therefore, frame 5, and frame 6 may correspond to the one or more non-speech frames.

"Pause" may refer to a time duration determined between two audio segments of an audio signal. In an embodiment, the pause may also be identified based on a non-speech frame in the audio segment, such that the time duration of the non-speech frame may correspond to the pause. In another embodiment, the pause in an audio segment may be identified from a set of temporally adjacent one or more non-speech frames in the audio segment, such that the collective time duration of the set of temporally adjacent one or more non-speech frames may correspond to the pause. In an embodiment, the time duration between the two audio segments, or the collective time duration of the set of temporally adjacent one or more non-speech frames of an audio segment of an audio signal may be considered as the pause only if the time duration or the collective time duration of the set of temporally adjacent one or more non-speech frames exceeds a predetermined duration. For example, referring Table 1, time between a first audio segment of user 1 (00:00-01:04) and a second audio segment of user 2 (01:06-02:34) that is 2 seconds may refer to the pause duration determined between the first audio segment and the second audio segment. Further, if the predetermined fixed time is 2.5 seconds, the time duration between the first audio segment of user 1 (00:00-01:04) and the second audio segment of user 2 (01:06-02:34) may not be considered as the pause.

"One or more first features" may refer to one or more parameters of an audio signal that may be unique for the audio signal. In an embodiment, the one or more first features of the audio signal may be determined by a computing device by utilizing one or more speech processing techniques on the audio signal. In an embodiment, the one or more first features may be determined for one or more audio segments of the audio signal. In an embodiment, the one or more first features are listed in the following table:

TABLE 3

Illustration of the one or more first features and the one or more speech processing techniques utilized for determining the corresponding one or more first features.

| One or more first features | Speech processing technique used for determination |
|---|---|
| Information pertaining to one or more voiced frames | Voice/unvoiced classification |
| Information pertaining to one or more unvoiced frames | Voice/unvoiced classification |
| Information pertaining to one or more speech frames | Speech activity detection |
| Information pertaining to one or more non-speech frames | Speech activity detection |
| Pitch contour | Pitch tracking |
| Frequency contour | Harmonic frequency tracking |
| Intensity contour | Energy computation |
| Spectrogram | Spectrogram computation |
| One or more first coefficients | Transform technique |

An "interrogative category" may refer to a category in which an audio signal may be classified. In an embodiment, the content in the audio signal, categorized in the interrogative category, may correspond to a question statement. In another embodiment, one or more audio segments of the audio signal may also be classified in to the interrogative category, if the one or more audio segments correspond to the question statement.

A "non-interrogative category" may refer to a category in which an audio signal may be classified. In an embodiment, the content in the audio signal, categorized in the non-interrogative category, may not correspond to a question statement. In another embodiment, one or more audio segments of the audio signal may also be classified in to the non-interrogative category, if the one or more audio segments do not correspond to the question statement.

"One or more pitch values" may correspond to one or more fundamental frequency values associated with an audio segment. In an embodiment, if the audio segment is segmented into one or more voiced frames and one or more unvoiced frames, the one or more pitch values may exist only for the one or more voiced frames of the audio segment. In an embodiment, the one or more pitch values of the audio segment may be determined from a pitch contour obtained by performing one or more pitch tracking algorithms on the audio segment.

"One or more harmonic frequencies" may refer to one or more frequencies in an audio signal corresponding to acoustic resonance of a vocal tract. In an embodiment, the one or more harmonic frequencies may be determined from a frequency contour of the audio signal. Further, based on the one or more harmonic frequencies, one or more audio signals may be differentiated from one another. In an embodiment, the one or more harmonic frequencies may be determined for an audio segment of the audio signal. In an embodiment, the one or more harmonic frequencies may be determined for one or more voiced frames and one or more unvoiced frames of the audio signal. In an embodiment, the one or more harmonic frequencies may be determined from each of one or more audio segments of the audio signal. In an embodiment, the one or more harmonic frequencies may correspond to the one or more formants (i.e., human vocal tract resonances) in the audio signal. Examples of one or more algorithms for determining the one or more harmonic frequencies are Cepstral Spectrum Smoothing, Hidden Markov Model, Line Spectrum Pairs, and/or the like.

"One or more intensity values" may refer to one or more values obtained from an intensity contour of an audio signal. In an embodiment, the intensity contour may be determined based on energy associated with the audio signal. In an embodiment, the intensity contour may comprise one or more intensity peaks. In an embodiment, the one or more intensity peaks may represent the presence of one or more syllables in the audio signal. In an embodiment, the intensity contour may also be determined for an audio segment of the audio signal. In an embodiment, the intensity contour of the audio signal may be determined by performing one or more speech processing techniques on the audio segment. Examples of the one or more speech processing techniques used for determining the intensity contour are short time energy computation technique, and/or the like.

A "spectrogram" may refer to a visual representation of one or more frequencies in an audio signal, such that x-axis of the spectrogram denotes time, and y-axis of the spectrogram denotes frequency, or vice-versa. The spectrogram may further comprise a third dimension represented by an image, wherein each point in the image denotes an amplitude of the one or more frequencies at a particular time instant of the audio signal. In an embodiment, the spectrogram may further be utilized to determine an intensity contour, and a frequency contour of the audio signal. In an embodiment, the spectrogram may be determined for each of one or more audio segments of the audio signal.

"One or more filter banks" may refer to an array of band-pass filters. In an embodiment, the one or more filter banks may be utilized to decompose an input signal into one or more frequency components. In an embodiment, the input signal may correspond to an audio signal. In an alternate embodiment, the input signal may correspond to an audio segment of the audio signal. In an embodiment, a spectrogram of the audio signal may be passed through the one or more filter banks to determine one or more filter bank outputs, such that each filter bank output may correspond to a frequency in the one or more frequencies.

"Energy" of an audio signal may refer to one or more amplitude variations in the audio signal. In another embodiment, the energy may be determined for an audio segment of the audio signal. In an embodiment, the energy of the audio signal may be determined by using one or more energy computation techniques such as, but are not limited to, a window technique.

A "timestamp" may refer to a time instant corresponding to a start time and an end time of an audio signal. In an embodiment, the timestamp may be determined for an audio segment of the audio signal. In an embodiment, the time stamp may be represented in a known standard format (e.g., minutes: seconds: milliseconds), such as $M_1M_1{:}S_1S_1{:}m_1m_1m_1$ (start time instant)—$M_2M_2{:}S_2S_2{:}m_2m_2m_2$ (end time instant). In an embodiment, the time stamp may be utilized to determine a time duration lapsed between the start time instant and the end time instant of the audio signal. Further, the timestamp may be utilized to determine various time related features of the audio signal such as pause duration and/or the like. In another embodiment, the timestamp may comprise a time instant corresponding to occurrence of a pitch value in a pitch contour, a harmonic frequency value in a frequency contour of the audio signal.

A "first time duration" may refer to a time duration corresponding to time elapsed between a start time instant and an end time instant of an audio segment. In an embodiment, the first time duration may be determined from a timestamp associated with the audio segment. For example, a processor may determine the timestamp associated with an audio segment, such as 02:04:111-02:54:132, then 50 second 21 milliseconds (i.e., time elapsed between the start time instant and the end time instant of the audio segment) may correspond to the first time duration of the audio segment.

A "second time duration" may refer to a time duration corresponding to time elapsed between a start time instant and an end time instant of a voiced frame. In an embodiment, the second time duration may be determined from a timestamp associated with the voiced frame. For example, a processor may determine the timestamp associated with a voiced frame, such as 02:04:102-02:04:132, then 30 milliseconds (i.e., time elapsed between the start time instant and the end time instant of the voiced frame) may correspond to the second time duration of the voiced frame.

A "third time duration" may refer to a time duration corresponding to time elapsed between a start time instant and an end time instant of a continuous voiced frame. In an embodiment, the continuous voiced frame may comprise one or more temporally adjacent voiced frames. Thus, the third time duration of the continuous voiced frame may be determined from a timestamp corresponding to a temporally first voiced frame and a temporally last voiced frame in the continuous voiced frame. In an embodiment, the third time duration of a continuous voiced frame may correspond to the time elapsed between the start time instant of the temporally first voiced frame (i.e., start time instant of the continuous voiced frame) and the end time instant of the temporally last voiced frame (i.e., end time instant of the continuous voiced frame) in the continuous voiced frame. For example, a processor may determine the timestamp associated with a temporally first voiced frame, such as 02:04:102-02:04:132 and a timestamp associated with a temporally last voiced frame, such as 02:05:121-02:05:151, then 1 second 49 milliseconds, i.e., time elapsed between the start time instant and the end time instant of the continuous voiced frame, may correspond to the third time duration of the continuous voiced frame.

A "fourth time duration" may refer to a time duration corresponding to time elapsed between a start time instant and an end time instant of a speech frame. In an embodiment, the fourth time duration may be determined from a timestamp associated with the speech frame. For example, a processor may determine the timestamp associated with a speech frame, such as 02:04:102-02:04:132, then 30 milliseconds, i.e., time elapsed between the start time instant and the end time instant of the speech frame, may correspond to the fourth time duration of the speech frame.

A "fifth time duration" may refer to a time duration corresponding to time elapsed between a start time instant and an end time instant of a continuous speech frame. In an embodiment, the continuous speech frame may comprise one or more temporally adjacent speech frames. Thus, the fifth time duration of the continuous speech frame may be determined from a timestamp corresponding to a temporally first speech frame and a temporally last speech frame in the continuous speech frame. In an embodiment, the fifth time duration of a continuous speech frame may correspond to the time elapsed between the start time instant of the temporally first speech frame (i.e., start time instant of the continuous speech frame) and the end time instant of the temporally last speech frame (i.e., end time instant of the continuous speech frame) in the continuous speech frame. For example, a processor may determine the timestamp associated with a temporally first speech frame, such as 02:04:102-02:04:132 and a timestamp associated with a temporally last speech frame, such as 02:05:121-02:05:151, then 1 second 49 milliseconds, i.e., time elapsed between the start time and the end time of the continuous speech frame, may correspond to the fifth time duration of the continuous speech frame.

"One or more second features" may refer to one or more parameters of an audio signal determined by processing one or more first features of the audio signal. In an embodiment, the one or more second features may be determined for an audio segment of the audio signal.

"One or more third features" may refer to one or more parameters of an audio signal determined by processing one or more first features of each of a first audio signal and a second audio signal. For example, a processor may determine one or more second features of the first audio signal from the one or more first features. Similarly, the processor may determine one or more second features of the second audio signal. Further, the processor may determine the one or more third features by use of at least the one or more second features of the first audio signal and the one or more second features of the second audio signal. In an embodiment, the one or more third features may be determined for a first audio segment of the audio signal.

"Classifier" refers to a mathematical model that may be configured to categorize an input signal or a part of the input signal in one of one or more categories. In an embodiment, the classifier is trained based on training data. Examples of the one or more techniques that may be utilized to train a classifier include, but are not limited to, a Support Vector Machine (SVM), a Logistic Regression, a Bayesian Classifier, a Decision Tree Classifier, a Copula-based Classifier, a K-Nearest Neighbors (KNN) Classifier, or a Random Forest (RF) Classifier.

FIG. 1 is a block diagram illustrating a system environment 100 in which various embodiments may be implemented. The system environment 100 includes an application server 102, a database server 104, a network 106, and a user-computing device 108.

In an embodiment, the application server 102 may refer to a computing device or a software framework hosting an application or a software service. In an embodiment, the application server 102 may be implemented to execute procedures such as, but not limited to, programs, routines, or scripts stored in one or more memories for supporting the hosted application or the software service. In an embodiment, the hosted application or the software service may be configured to perform one or more predetermined operations. In an embodiment, the application server 102 may receive an audio signal from the database server 104, based on at least a query transmitted to the database server 104. The application server 102 may further be configured to segment the audio signal in one or more audio segments, such that each audio segment comprises an uninterrupted audio of a user. In an embodiment, the application server 102 may be configured to determine one or more first features associated with each of the one or more audio segments by use of one or more speech processing techniques. Further, in an embodiment, the application server 102 may be configured to determine one or more second features of each of the one or more audio segments based on the one or more first features. Furthermore, in an embodiment, the application server may be configured to determine one or more third features for each of the one or more audio segments based at least on a second feature of the one or more second features associated with each of the one or more audio segments. Thereafter, in an embodiment, the application server 102 may be configured to classify each of the one or more audio segments of the audio signal into an interrogative category or a non-interrogative category based on one or more of the corresponding one or more second features and the corresponding one or more third features. In an embodiment, the application server 102 may utilize one or more classifiers to classify the one or more audio segments.

In an embodiment, prior to classifying the one or more audio segments, the application server 102 may be configured to train the one or more classifiers by use of training data. In an embodiment, the application server 102 may determine the training data by use of a crowdsourcing platform. For example, the application server 102 may crowdsource one or more other audio segments to one or more workers, such that the one or more workers are presented a task of classifying the one or more other audio segments into the interrogative category or the non-interrogative category. Further, the application server 102 may be configured to determine the one or more first features, the one or more second features and the one or more third features corresponding to the one or more other audio segments in the interrogative category. In another embodiment, the application server 102 may be configured to determine the one or more first features, the one or more second features and the one or more third features for the one or more other audio segments in the interrogative category and the one or more other audio segments in the non-interrogative category. In an embodiment, the application server 102 may be configured to store the one or more second features and the one or more third features, corresponding to the interrogative one or more audio segments, in the database server 104. In an embodiment, the one or more second features and the one or more third features, corresponding to the interrogative one or more other audio segments, may constitute the training data. Thereafter, the application server 102 may utilize the training data, extracted from the database server 104, to train the one or more classifiers.

A person having ordinary skill in the art will understand that the scope of determining the training data is not limited to crowdsourcing the one or more other audio segments, as discussed above. In an alternate embodiment, the application server 102, may download the one or more interrogative audio segments from a website for determining the training data.

The application server 102 may be realized through various types of application servers such as, but are not limited to, a Java application server, a .NET framework application server, a Base4 application server, a PHP framework application server, or any other application server framework. The operation of the application server 102 has been discussed later in FIG. 2.

In an embodiment, the database server 104 may refer to a computing device that may be configured to store one or more audio signals, and the one or more audio segments extracted from each of the one or more audio signals. Further, the database server 104 may be configured to store the one or more first features, the one or more second features, and the one or more third features associated with the one or more audio segments of the one or more audio signals. In an embodiment, the database server 104 may be configured to store the training data that may be utilized by the application server 102 to train the one or more classifiers.

In an embodiment, the database server 104 may be configured to transmit one or more queries to one or more sources to retrieve the one or more audio signals and the training data. Examples of the one or more of sources may include, but are not limited to, websites, call center repositories, crowdsourcing platform server, and streaming servers. In an embodiment, an entity may use a computing device to upload the one or more audio signals to the database server 104. Examples of the entity may include, but are not limited to, a call center, and an online audio streaming service provider.

Further, in an embodiment, the database server 104 may receive a query from the application server 102 to retrieve an audio signal of the one or more audio signals. Thereafter, the database server 104 may be configured to transmit the audio signal to the application server 102, via the network 106.

For querying the database server 104, the application server 102 may utilize one or more querying languages such as, but not limited to, SQL, QUEL, DMX and so forth. Further, the database server 104 may be realized through various technologies such as, but not limited to, Microsoft® SQL server, Oracle, and My SQL. In an embodiment, the database server 104 may connect to the application server 102, using one or more protocols such as, but not limited to, ODBC protocol and JDBC protocol.

A person with ordinary skill in the art will understand that the scope of the disclosure is not limited to the database server 104 as a separate entity. In an embodiment, the functionalities of the database server 104 may be integrated into the application server 102, and vice versa.

In an embodiment, the network 106 may correspond to a communication medium through which the database server 104, the application server 102, and the user-computing device 108 may communicate with each other. Such a communication may be performed in accordance with various wired and wireless communication protocols. Examples of such wired and wireless communication protocols include, but are not limited to, Transmission Control Protocol and Internet Protocol (TCP/IP), User Datagram Protocol (UDP), Hypertext Transfer Protocol (HTTP), File Transfer Protocol (FTP), ZigBee, EDGE, infrared (IR), IEEE 802.11, 802.16, 2G, 3G, 4G cellular communication protocols, and/or Bluetooth (BT) communication protocols. The network 106 may include, but is not limited to, the Internet, a cloud network, a Wireless Fidelity (Wi-Fi) network, a Wireless Local Area Network (WLAN), a Local Area Network (LAN), a telephone line (POTS), and/or a Metropolitan Area Network (MAN).

In an embodiment, the user-computing device 108 may refer to a computing device that may be utilized by a user for communicating with one or more other users. The user-computing device 108 may comprise one or more processors and one or more memories. The one or more memories may include a computer readable code that may be executable by the one or more processors to perform one or more predetermined operations. In an embodiment, the user-computing device 108 may be configured to transmit the one or more audio signals to the application server 102. Prior to transmitting the one or more audio signals, the user of the user-computing device 108 may connect with the one or more other users over the network 106. For example, the user-computing device 108 may be associated with a customer care representative in a call center. Further, the user-computing device 108 may record a conversation between the customer care representative and a customer. The recorded conversation may correspond to the audio signal. Thereafter, the user-computing device 108 may store the audio signal in a call center repository or the database server 104.

In an embodiment, the user may utilize the user-computing device 108 to input one or more requests pertaining to the processing of the one or more audio signals. Examples of the user-computing device 108 may include, but are not limited to, a personal computer, a laptop, a personal digital assistant (PDA), a mobile device, a tablet, or any other computing device.

A person with ordinary skill in the art will understand that the scope of the disclosure is not limited to the user-computing device 108 as a separate entity. In an embodiment, the functionalities of the user-computing device 108 may be integrated into the application server 102, and vice versa.

Figure 2:
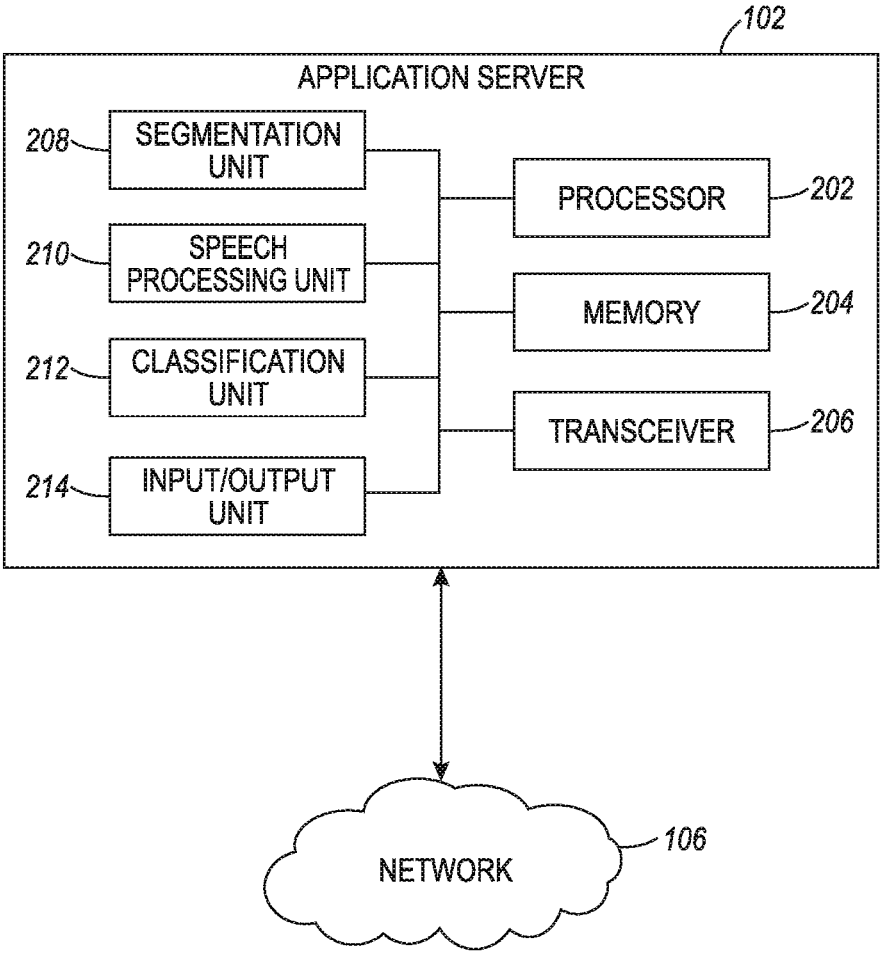
FIG. 2 is a block diagram illustrating an application server, in accordance with at least one embodiment.

FIG. 2 is a block diagram illustrating the application server 102, in accordance with at least one embodiment. FIG. 2 has been explained in conjunction with FIG. 1.

The application server 102 may include a processor 202, a memory 204, a transceiver 206, a segmentation unit 208, a speech processing unit 210, a classification unit 212, and an input/output unit 214. The processor 202 may be communicatively coupled to the memory 204, the transceiver 206, the segmentation unit 208, the speech processing unit 210, the classification unit 212, and the input/output unit 214. The transceiver 206 may be communicatively coupled to the network 106.

The processor 202 comprises suitable logic, circuitry, interfaces, and/or code that may be configured to execute a set of instructions stored in the memory 204. The processor 202 may be implemented based on a number of processor technologies known in the art. The processor 202 may work in coordination with the transceiver 206, the segmentation unit 208, the speech processing unit 210, the classification unit 212, and the input/output unit 214. The processor 20 may be configured to perform one or more predefined operations. For example, a segmentation of an audio signal into one or more audio segments by use of one or more state-of-the-art-algorithms, such as hidden Markov model, Conditional Random fields, and/or the like, and identify a timestamp associated with each of the one or more audio segments. Further, the processor 202 may be configured to determine a first time duration associated with each of the one or more audio segments based on the timestamp, such that the first time duration of an audio segment may correspond to time elapsed between the start time instant and the end time instant of the audio segment. In an embodiment, the processor 202 may be configured to store the one or more audio segments and the corresponding first time duration in the database server 104. In an embodiment, the processor 202 may be configured to store the one or more audio segments in a temporally sequential order in the database server 104. Further, the processor 202 may be configured to classify the one or more audio segments of each of the one or more audio signals into the interrogative category or the non-interrogative category.

Examples of the processor 202 include, but are not limited to, an X86-based processor, a Reduced Instruction Set Computing (RISC) processor, an Application Specific Integrated Circuit (ASIC) processor, a Complex Instruction Set Computing (CISC) processor, and/or other processor.

The memory 204 stores a set of instructions and data. Some of the commonly known memory implementations include, but are not limited to, a random access memory (RAM), a read only memory (ROM), a hard disk drive (HDD), a solid state drive (SDD) and a secure digital (SD) card. Further, the memory 204 includes the one or more instructions that are executable by the processor 202 to perform specific operations on the audio signals. It is apparent to a person having ordinary skill in the art that the one or more instructions stored in the memory 204 enables the hardware of the application server 102 to perform the specific operations on the audio signals.

The transceiver 206 comprises suitable logic, circuitry, interfaces, and/or code that may be configured to receive the one or more audio signals from the database server 104, via the network 106. In an alternate embodiment, the transceiver 206 may be configured to receive the one or more audio signals from a user-computing device 108. The transceiver 206 may implement one or more known technologies to support wired or wireless communication with the network 106. In an embodiment, the transceiver 206 may include, but is not limited to, an antenna, a radio frequency (RF) transceiver, one or more amplifiers, a tuner, one or more oscillators, a digital signal processor, a Universal Serial Bus (USB) device, a coder-decoder (CODEC) chipset, a subscriber identity module (SIM) card, and/or a local buffer. The transceiver 206 may communicate via wireless communication with networks, such as the Internet, an Intranet and/or a wireless network, such as a cellular telephone network, a wireless local area network (LAN) and/or a metropolitan area network (MAN). The wireless communication may use any of a plurality of communication standards, protocols and technologies, such as: Global System for Mobile Communications (GSM), Enhanced Data for GSM Evolution (EDGE), wideband code division multiple access (W-CDMA), code division multiple access (CDMA), time division multiple access (TDMA), Bluetooth, Wireless Fidelity (Wi-Fi) (e.g., IEEE 802.11a, IEEE 802.11b, IEEE 802.11g and/or IEEE 802.11n), voice over Internet Protocol (VoIP), Wi-MAX, a protocol for email, instant messaging, and/or Short Message Service (SMS).

The segmentation unit 208 comprises suitable logic, circuitry, interfaces, and/or code that may be configured to further segment the one or more audio segments. In an embodiment, the segmentation unit 208 may segment each of the one or more audio segments into overlapping frames in time domain to generate one or more audio frames. Further, the one or more audio frames are of a fixed predetermined time duration. The fixed predetermined time duration may be defined by a user. The segmentation unit 208 may utilize one or more state-of the-art segmentation techniques, for generating the one or more audio frames, such as hidden Markov model, Conditional Random fields, and/or the like. Thereafter, the segmentation unit 208 may be configured to store the one or more audio frames in the database server 104. In an embodiment, the one or more audio frames are stored, in the database server 104, in a temporally sequential order.

In an embodiment, the segmentation unit 208 may be implemented using one or more processor technologies known in the art. Examples of the segmentation unit 208 include, but are not limited to, an X86, a RISC processor, a CISC processor, or any other processor. In another embodiment, the segmentation unit 208 may be implemented as an Application-Specific Integrated Circuit (ASIC) microchip designed for a special application, such as segmenting the one or more audio segments into the one or more audio frames.

The speech processing unit 210 comprises suitable logic, circuitry, interfaces, and/or code that may be configured to determine the one or more first features associated with the one or more audio segments. In an embodiment, the speech processing unit 210 may be configured to utilize the one or more speech processing techniques for determining the one or more first features corresponding to each of the one or more audio segments. Examples of the one or more speech processing techniques may comprise, but are not limited to, a voiced/unvoiced classification, a pitch tracking, a harmonic frequency tracking, a speech activity detection, and a spectrogram computation. In an embodiment, the one or more first features may comprise an information. The information may correspond to a classification of the one or more audio frames into a voiced frame or an unvoiced frame. The information may further correspond to classification of the one or more audio frames into a speech frame or a non-speech frame, a pitch contour of the audio segment, one or more harmonic frequencies of the audio segment a frequency contour of the audio segment, an intensity contour of the audio segment, a spectrogram of the audio segment and one or more first coefficients of the audio segment. Examples of the one or more first features have been referred supra in Table 3.

In an embodiment, the speech processing unit 210 may be configured to determine the one or more second features for each of the one or more audio segments based on the one or more first features of each of the one or more audio segments. Further, the speech processing unit 210 may be configured to determine the one or more third features for each of the one or more audio segments. In an embodiment, one third feature of the one or more third features of a first audio segment, in the one or more audio segments, is determined based on a second feature of the one or more second features of the first audio segment and at least one corresponding second feature of a second audio segment, in the one or more audio segments. In an embodiment, the second audio segment may be temporally adjacent to the first audio segment. The speech processing unit 210 may be implemented using one or more processor technologies known in the art. Examples of the speech processing unit 210 include, but are not limited to, an X86, a RISC processor, a CISC processor, or any other processor. In another embodiment, the speech processing unit 210 may be implemented as an Application-Specific Integrated Circuit (ASIC) microchip designed for a special application, such as determining the one or more first features, the one or more second features and the one or more third features for each of the one or more audio segments. The determination of the one or more first features, the one or more second features, and the one or more third features has been described later in FIG. 3.

The classification unit 212 comprises suitable logic, circuitry, interfaces, and/or codes that may be configured to classify each of the one or more audio segments of the audio signal in either the interrogative category or the non-interrogative category based on the corresponding one or more second features and the corresponding one or more third features. In an embodiment, the classification unit 212 may classify the one or more audio segments into the interrogative category or the non-interrogative category using the one or more classifiers.

Prior to the classification of the one or more audio segments, the classification unit 212 may be configured to train the one or more classifiers based on the training data. In an embodiment, the classification unit 212 may extract the training data from the database server 104 for training the one or more classifiers. Thereafter, the classification unit 212 may utilize the trained one or more classifiers for classifying the one or more audio segments into one of the interrogative category and the non-interrogative category.

The classification unit 212 may be implemented using one or more processor technologies known in the art. Examples of the classification unit 212 may include, but are not limited to, an X86, a RISC processor, a CISC processor, or any other processor. In another embodiment, the classification unit 212 may be implemented as an Application-Specific Integrated Circuit (ASIC) microchip designed for a special application, such as classifying the one or more audio segments in either the interrogative category or the non-interrogative category.

The input/output unit 214 comprises suitable logic, circuitry, interfaces, and/or code that may be configured to receive an input or transmit an output to the user-computing device 108. The input/output unit 214 comprises various input and output devices that are configured to communicate with the processor 202. Examples of the input devices include, but are not limited to, a keyboard, a mouse, a joystick, a touch screen, a microphone, a camera, and/or a docking station. Examples of the output devices include, but are not limited to, a display screen and/or a speaker.

Figure 3A:
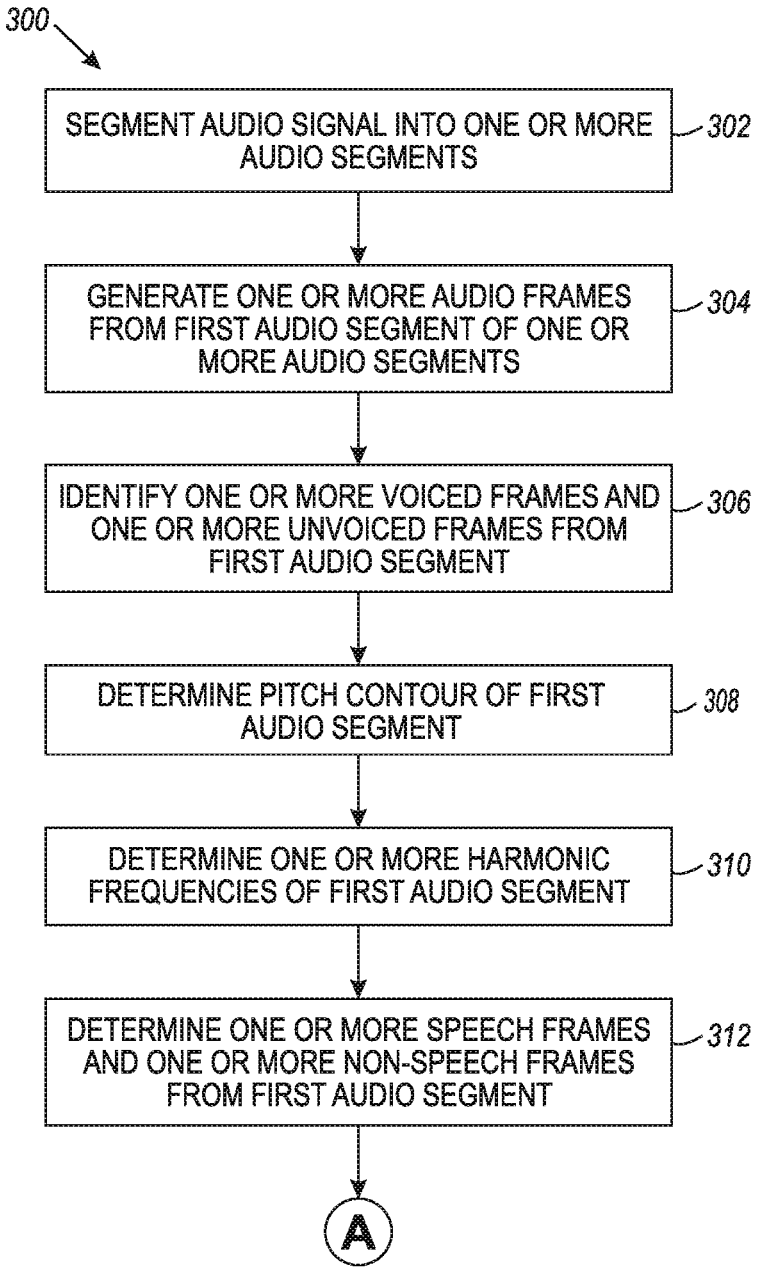
FIG. 3A and FIG. 3B are flowcharts illustrating a method for classifying one or more audio segments of an audio signal, in accordance with at least one embodiment.
Figure 3B:
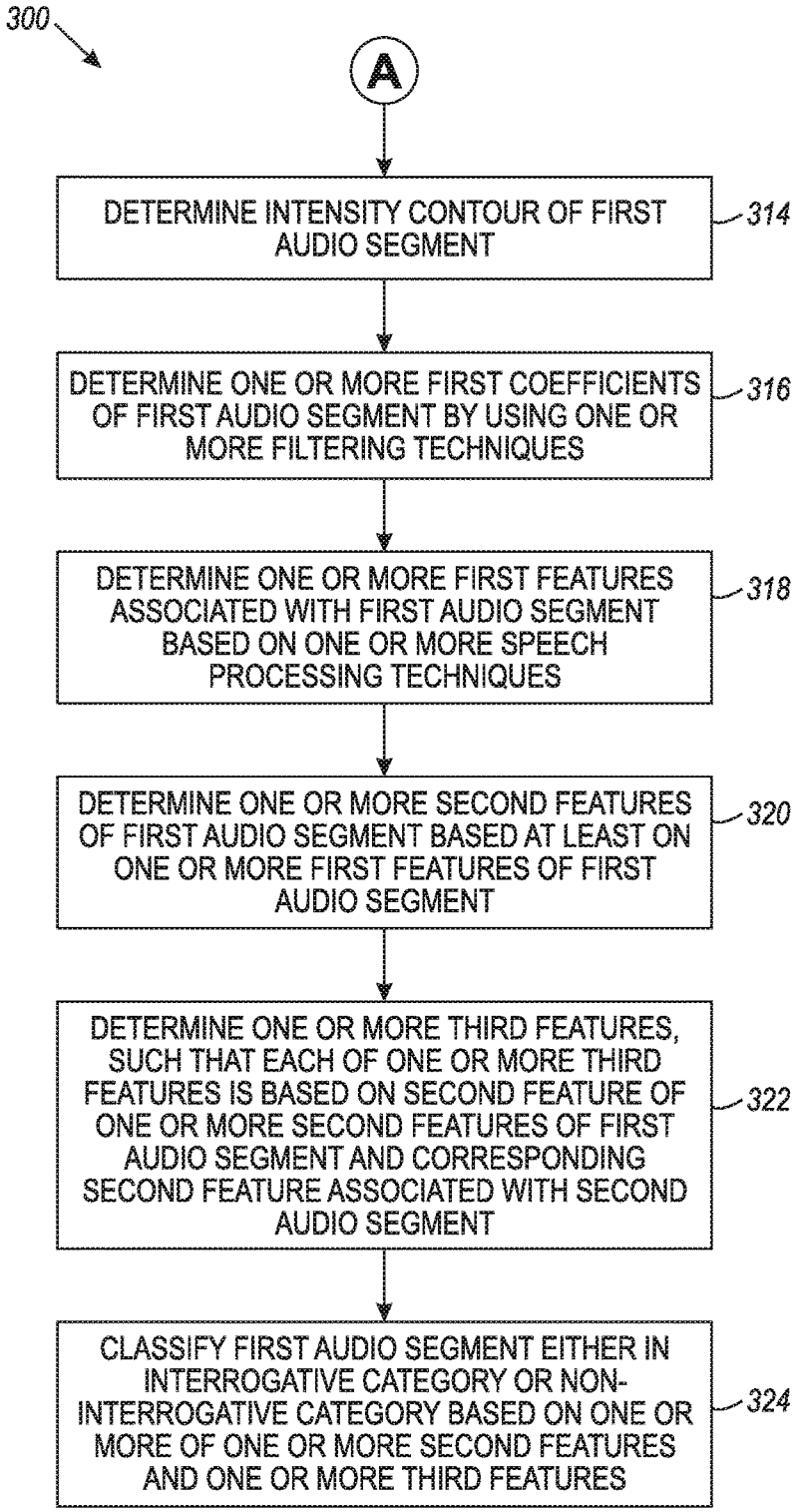

The operation of the application server 102 has been described in FIGS. 3A and 3B.

FIGS. 3A and 3B are flowcharts 300 that illustrate the method for classifying the one or more audio segments of the audio signal, in accordance with at least one embodiment. The flowcharts 300 have been described in conjunction with FIG. 1, and FIG. 2.

At step 302, the audio signal is segmented into the one or more audio segments. In an embodiment, the processor 202 may be configured to segment the audio signal into the one or more audio segments. Prior to segmenting the audio signal, the processor 202 may retrieve the audio signal from the database server 104. As discussed, the audio signal may correspond to a conversation between a first user and a second user. For example, the audio signal may correspond to a conversation between a customer care representative and a customer.

For the purpose of ongoing description, hereinafter, the method has been explained with respect to a first audio segment of the one or more audio segments. However, the scope of the disclosure should not be construed limiting to the first audio segment. In an embodiment, the following steps can also be performed for the remaining one or more audio segments.

At step 304, the one or more audio frames are generated from the first audio segment. In an embodiment, the segmentation unit 208 in conjunction with the processor 202 may be configured to generate the one or more audio frames from the first audio segment of the one or more audio segments. In an embodiment, the segmentation unit 208 may segment the first audio segment to generate the one or more audio frames by using one or more state-of the-art segmentation techniques, such as hidden Markov model, Conditional Random fields, and/or the like. Table 4 illustrates the one or more audio frames of the first audio segment and the corresponding timestamp, as generated by the segmentation unit 208.

TABLE 4

Illustration of the one or more audio frames, and the corresponding timestamp of the one or more audio frames.

| One or more audio frames | Timestamp (MM:SS:mmm) |
|---|---|
| Frame 1 | 00:00:000-00:00:030 |
| Frame 2 | 00:00:010-00:00:040 |
| Frame 3 | 00:00:020-00:00:050 |
| Frame 4 | 00:00:030-00:00:060 |

TABLE 4-continued

| Illustration of the one or more audio frames, and the corresponding timestamp of the one or more audio frames. | |
|---|---|
| One or more audio frames | Timestamp (MM:SS:mmm) |
| Frame 5 | 00:00:040-00:00:070 |
| Frame 6 | 00:00:050-00:00:080 |
| Frame 7 | 00:00:060-00:00:090 |

Referring to Table 4, frame 1, frame 2, frame 3, frame 4, frame 5, frame 6 and frame 7 correspond to the one or more audio frames of the first audio segment as generated by the segmentation unit 208. Further, as shown in Table 4, the adjacent one or more audio frames have the overlap of 20 ms and are spaced at 10 ms from each other.

At step 306, the one or more voiced frames and the one or more unvoiced frames are identified, from the first audio segment. In an embodiment, the speech processing unit 210 in conjunction with the processor 202 may be configured to identify the one or more voiced frames and the one or more unvoiced frames from the first audio segment. In an embodiment, the speech processing unit 210 may identify the one or more voiced frames and the one or more unvoiced frames from the one or more audio frames of the audio segment. The speech processing unit 210 may use known in the art voiced/unvoiced classification techniques for identifying an audio frame as the voiced frame or as the unvoiced frame. Examples of the techniques are wavelet based voiced/unvoiced classification technique, zero crossing rate for voiced/unvoiced classification technique, and/or the like.

In an embodiment, the speech processing unit 210 may assign a first binary value to the one or more audio frames indicating whether the audio frame is a voiced frame or an unvoiced frame. For example, an audio frame with a first binary value "1" may represent the voiced frame and the audio frame with the first binary value "0" may represent the unvoiced frame. Hereinafter, the one or more audio frames in the first audio segment with the first binary value "1" are referred to as the one or more voiced frames and the one or more audio frames with the first binary value "0" are referred as the one or more unvoiced frames.

In an embodiment, the speech processing unit 210 may be configured to determine a second time duration for each of the one or more voiced frames based on the corresponding timestamp. Further, the second time duration of a voiced frame in the one or more voiced frames may correspond to the time elapsed between a start time instant and an end time instant of the voiced frame. Thereafter, the speech processing unit 210 may store the second time duration of each of the one or more voiced frames in the database server 104.

A person having ordinary skill in the art will understand that voiced frames in the one or more voiced frames may be temporally adjacent to each other, or an unvoiced frame may be interlaced between any two voiced frames.

In an embodiment, the speech processing unit 210 may identify one or more continuous voiced frames, such that each continuous voiced frame comprises the one or more voiced frames that are temporally adjacent to each other. In an embodiment, a duration of a continuous voiced frame in the one or more continuous voiced frames may depend on the second time duration of the temporally adjacent voiced frames. Further, a start time instant of the continuous voiced frame may correspond to the start time instant of a temporally first voiced frame in the continuous voiced frame. Further, an end time instant of the continuous voiced frame may correspond to the end time instant of a temporally last voiced frame in the continuous voiced frame. In an embodiment, the speech processing unit 210 may be configured to determine a third time duration for each of the one or more continuous voiced frames, based on the time elapsed during the start time instant of the continuous voiced frame and the end time instant of each of the continuous voiced frames. In an embodiment, the speech processing unit 210 may be configured to store the third time duration corresponding to each of the one or more continuous voiced frames in the database server 104, over the network 106.

A person having ordinary skill in the art will understand that if there is a single voiced frame interlaced between two unvoiced frames, the single voiced frame may also correspond to a continuous voiced frame with the third time duration equal to the second time duration of the single voiced frame.

Table 5 illustrates the one or more audio frames, the corresponding first binary value and the corresponding timestamp of the one or more audio frames.

TABLE 5

| Illustration of the one or more audio frames, the corresponding first binary values, and the corresponding time stamp of the one or more audio frames. | | |
|---|---|---|
| One or more audio frames | First binary value | Timestamp (MM:SS:mmm) |
| Frame 1 | 1 | 00:00:000-00:00:030 |
| Frame 2 | 1 | 00:00:010-00:00:040 |
| Frame 3 | 0 | 00:00:020-00:00:050 |
| Frame 4 | 1 | 00:00:030-00:00:060 |
| Frame 5 | 1 | 00:00:040-00:00:070 |
| Frame 6 | 1 | 00:00:050-00:00:080 |
| Frame 7 | 0 | 00:00:060-00:00:090 |

Referring to Table 5, based on the known in the art voiced/unvoiced classification techniques, the speech processing unit 210 may identify frame 1, frame 2, frame 4, frame 5, and frame 6 as the one or more voiced frames and may further assign the first binary value "1" to the identified voiced frames. Further, the speech processing unit 210 may identify frame 3, and frame 7 as the one or more unvoiced frames, and may further assign the first binary value "0" to the identified unvoiced frames. Further, the second time duration of each of the one or more voiced frames is determined from the corresponding timestamp, i.e., for frame 1 the second time duration is 30 ms. The two continuous voiced frames CF1→(frame 1 and frame 2) and CF2→(frame 4, frame 5 and frame 6) are identified as, frame 1 and frame 2 in CF1 are temporally adjacent, and frame 4, frame 5 and frame 6 in CF2 are also temporally adjacent. Further, based on a start time instant of the first voiced frame (frame 1) in the continuous voiced frame (CF1) and an end time instant of the last voiced frame (frame 2) in the continuous voiced frame (CF1) the third time duration for the continuous voiced frame CF1 is determined to be 40 ms.

A person having ordinary skill in the art will understand that the abovementioned example is for illustrative purpose and should not be construed to limit the scope of the disclosure.

At step 308, the pitch contour of the first audio segment is determined. In an embodiment, the speech processing unit 210 in conjunction with the processor 202 may be configured to determine the pitch contour of the first audio segment. In an embodiment, the pitch contour may comprise one or more pitch values. In an embodiment, the one or more pitch values in the pitch contour may correspond to the one or more voiced frames. In an embodiment, the pitch contour may represent a pitch value and a temporal location of the occurrence of the corresponding pitch value in the first audio segment. In an embodiment, the speech processing unit 210 may utilize one or more state-of-the-art algorithms, for determining the pitch contour, such as, but are not limited to, Snack algorithm, Praat algorithm, and SHR pitch track algorithm.

A person having ordinary skill in the art will understand that the pitch contour may not comprise any pitch value corresponding to the unvoiced frame of the first audio segment.

In an exemplary implementation, Table 6 illustrates the one or more pitch values and the corresponding temporal location determined from a pitch contour (PC) of a first audio segment (S1).

TABLE 6

Illustration of the one or more pitch values and the corresponding timestamp in the first audio segment.

| Pitch Value | Temporal location (MM:SS:mmm) |
|---|---|
| 233 Hz | 10:32:030 |
| 239 Hz | 10:33:040 |
| 228 Hz | 10:34:050 |
| — | 10:35:010 |
| 245 Hz | 10:36:030 |
| 234 Hz | 10:37:043 |
| 243 Hz | 10:38:053 |

Referring Table 6, the pitch value "245 Hz" is observed at a timestamp of 10:36:030 in the first audio segment (determined from the pitch contour). Further, the pitch value at the timestamp of 10:35:010 corresponds to an unvoiced frame in the first audio segment.

A person having ordinary skill in the art will understand that the abovementioned exemplary scenario is for illustration purpose and should not be construed to limit the scope of the disclosure.

At step 310, the one or more harmonic frequencies of the first audio segment are determined. In an embodiment, the speech processing unit 210 in conjunction with the processor 202 may be configured to determine the one or more harmonic frequencies of the first audio segment. As discussed supra, the first audio segment comprises the one or more audio segments, which are further identified as the one or more voiced frames and the one or more unvoiced frames. Therefore, in an embodiment, the one or more harmonic frequencies may also be determined for the one or more voiced frames and the one or more unvoiced frames of the first audio segment. In an embodiment, the one or more harmonic frequencies are represented as a frequency contour, comprising values of the one or more harmonic frequencies and a temporal location corresponding to an occurrence of the harmonic frequency in the first audio segment. In an embodiment, the speech processing unit 210 may be configured to determine a frequency histogram from the frequency contour of the first audio segment.

In an embodiment, the speech processing unit 210, for determining the one or more harmonic frequencies may utilize one or more state-of-the-art algorithms such as, but not limited to, Cepstral spectrum smoothing, Hidden Markov Model, and Line Spectrum Pairs.

At step 312, one or more speech frames and one or more non-speech frames are determined from the first audio segment. In an embodiment, the speech processing unit 210 in conjunction with the processor 202 may be configured to determine the one or more speech frames and the one or more non-speech frames. As discussed supra, the first audio segment may be segmented by the segmentation unit 208 to generate the one or more audio frames. In an embodiment, the speech processing unit 210 may determine the one or more speech frames and the one more non-speech frames from the one or more audio frames of the first audio segment. In an embodiment, the speech processing unit 210 may detect a presence of a speech (e.g., a human voice) in the one or more audio frames of the first audio segment. In an embodiment, the one or more audio frames comprising the speech may correspond to the one or more speech frames and the one or more audio frames without speech may correspond to the one or more non-speech frames. The speech processing unit 210 may utilize various speech activity detection techniques, such as deep neural networks, noise spectrum adaptation, adaptive multi-rate, and/or the like, for detecting the presence of speech in the one or more audio frames.

In an embodiment, the speech processing unit 210 may assign a second binary value, to the one or more audio frames, based on the presence speech in the one or more audio frames. For example, the speech processing unit 210 may assign a second binary value "1" to an audio frame with a speech, and a second binary value "0" to a frame without the speech. Further, the one or more audio frames with the second binary value as "1" are referred to as the one or more speech frames, and the one or more audio frames with the second binary value as "0" are referred to as the one or more non-speech frames.

After assigning the second binary value to each of the one or more audio frames, the speech processing unit 210 may be configured to store each of the one or more audio frames and the corresponding second binary value (i.e., the one or more speech frames and the one or more non-speech frames) in the database server 104.

In an embodiment, the speech processing unit 210 may be configured to determine a fourth time duration corresponding to each of the one or more speech frames. The speech processing unit 210 may determine the fourth time duration of a speech frame based on a start time instant and an end time instant of the speech frame (determined from the timestamp of the speech frame), such that the fourth time duration is equal to a time duration elapsed between the start time instant and the end time instant of the speech frame. Thereafter, the speech processing unit 210 may store the fourth time duration in the database server 104, via the network 106.

Table 7 illustrates seven audio frames of the first audio segment, a status of the presence of speech in the seven audio frames, a second binary value and a time stamp of each of the seven audio frames.

TABLE 7

Illustration of the one or more audio frames, the status of the presence of speech, the second binary value, and timestamp of each of the one or more audio frames.

| One or more audio frames | Presence of speech | Second binary value | Timestamp (MM:SS:mmm) |
|---|---|---|---|
| Frame 1 | Yes | 1 | 00:00:000-00:00:030 |
| Frame 2 | Yes | 1 | 00:00:010-00:00:040 |
| Frame 3 | No | 0 | 00:00:020-00:00:050 |
| Frame 4 | No | 0 | 00:00:030-00:00:060 |
| Frame 5 | No | 0 | 00:00:040-00:00:070 |

TABLE 7-continued

Illustration of the one or more audio frames, the status of the presence of speech, the second binary value, and timestamp of each of the one or more audio frames.

| One or more audio frames | Presence of speech | Second binary value | Timestamp (MM:SS:mmm) |
|---|---|---|---|
| Frame 6 | Yes | 1 | 00:00:050-00:00:080 |
| Frame 7 | Yes | 1 | 00:00:060-00:00:090 |

Referring to Table 7, the speech processing unit 210 may determine frame 1, frame 2, frame 6, and frame 7 as the one or more speech frames and assign the second binary value "1" and frame 3, frame 4, and frame 5 as the one or more non-speech frames with the second binary value "0". Further, the fourth time duration corresponding to frame 1 is determined to be 30 ms (based on the corresponding time stamp).

A person having ordinary skill in the art will understand that the speech frames in the one or more speech frames may be temporally adjacent to each other, or a non-speech frame may be interlaced between any two speech frames.

In an embodiment, the speech processing unit 210 may identify one or more continuous speech frames from the one or more speech frames and the one or more non-speech frames, such that each continuous speech frame comprises the one or more speech frames that are temporally adjacent to each other. In an embodiment, a duration of a continuous speech frame in the one or more continuous speech frames may depend on the fourth time duration of the one or more speech frames in the continuous speech frame. Further, a start time instant of the continuous speech frame may correspond to a start time instant of a temporally first speech frame in the continuous speech frame and an end time instant of the continuous speech frame may correspond to an end time instant of a temporally last speech frame in the continuous speech frame. In an embodiment, the speech processing unit 210 may be configured to determine a fifth time duration for each of the one or more continuous speech frames, such that the fifth time duration of a continuous speech frame corresponds to the time duration elapsed between the start time instant and the end time instant of the continuous speech frame. In an embodiment, the speech processing unit 210 may be configured to store the fifth time duration in the database server 104, over the network 106.

A person having ordinary skill in the art will understand that if there is a single speech frame interlaced between two non-speech frames, the single speech frame may also correspond to a continuous speech frame with the fifth time duration equal to the fourth time duration of the single speech frame.

Referring to Table 7, the speech processing unit 210 may identify two continuous speech frames ($C_{sf}1$ and $C_{sf}2$) in the first audio segment, i.e., $C_{sf}1\rightarrow$(frame 1 and frame 2) and $C_{sf}2\rightarrow$(frame 6 and frame 7), respectively. The fifth time duration corresponding to the continuous speech frame ($C_{sf}1$) is 40 ms (determined from the timestamp).

A person having ordinary skill in the art will understand that an audio frame in the one or more audio frames may be identified as a voiced frame (or an unvoiced frame) as well as a speech frame.

At step 314, the intensity contour of the first audio segment is determined. In an embodiment, the speech processing unit 210 may be configured to determine the intensity contour of the first audio segment. Further, the speech processing unit 210 may determine the intensity contour of the first audio segment based on energy of each of the one or more audio frames of the first audio segment. In another embodiment, the speech processing unit 210 may determine the intensity contour of the first audio segment based on a spectrogram of the first audio segment. In an embodiment, the intensity contour of the first audio segment may represent one or more intensity values, at a particular time instant, of the first audio segment. The speech processing unit 210 may utilize various state-of-the-art techniques to compute the energy of each of the one or more audio frames such as, but not limited to, Short time energy computation technique. A person having ordinary skills in the art will appreciate that one or more intensity peaks in the intensity contour may indicate a recitation of one or more syllables in the first audio segment.

As discussed supra, the first audio segment comprises one or more audio frames which are further identified as the one or more speech frames and the one or more non-speech frames by the speech processing unit 210. Therefore, a person having ordinary skill in the art will understand that the intensity contour of the first audio segment may also represent the one or more intensity values, at a particular time instant, of the one or more speech frames and the one or more non-speech frames of the first audio segment. In an embodiment, the speech processing unit 210 may be configured to represent the intensity contour of the first audio segment as an intensity histogram.

A person having ordinary skill in the art will understand that the scope of the disclosure is not limited to determining the intensity contour based on the energy of the each of the one or more audio frames.

At step 316, one or more first coefficients of the first audio segment are determined. In an embodiment, the speech processing unit 210 in conjunction with the processor 202 may be configured to determine the one or more first coefficients of the first audio segment by use of one or more filtering techniques. To determine the one or more first coefficients, the speech processing unit 210 may be configured to compute the spectrogram for the first audio segment. In an embodiment, the speech processing unit 210 may be configured to utilize one or more known in the art techniques for spectrogram computation. For example, the one or more known in the art techniques may include, but are not limited to, Fast Fourier Transform (FFT). In an embodiment, the speech processing unit 210 may divide the spectrogram of the first audio segment into one or more first chunks of a predetermined fixed time duration. Further, the speech processing unit 210 may use one or more filter banks (i.e., the one or more filtering techniques) on the one or more first chunks of the spectrogram to determine one or more filter bank outputs. Examples of the one or more filter banks are Mel filter bank, Linear prediction filter bank, and/or the like. Thereafter, the speech processing unit 210 may be configured to use the one or more transformation techniques on the one or more filter bank outputs to determine a set of first coefficients for each of the one or more filter bank outputs. Collectively, the set of first coefficients determined for each of the one or more filter bank outputs are referred to as the one or more first coefficients associated with the first audio segment. Examples of the one or more transformation techniques are Discrete Cosine transform, Discrete Fourier transform, and/or the like. In an embodiment, the speech processing unit 210 may be configured to store the spectrogram, the one or more filter bank outputs, and the one or more first coefficients in the database server 104.

At step 318, the one or more first features associated with the first audio segment of the one or more audio segments are determined based on the one or more speech processing techniques. In an embodiment, the speech processing unit 210 may consider the information pertaining to: the identification of the one or more audio frames as a voiced frame or an unvoiced frame (as discussed in step 306), the determination of the pitch contour of the audio segment (as discussed in step 308), the determination of the one or more harmonic frequencies of the audio segment and the frequency contour of the audio segment (as discussed in step 310), the determination of the one or more audio frames as a speech frame or a non-speech frame (as discussed in step 312), the determination of the intensity contour of the audio segment (as discussed in step 314), and the determination of the spectrogram of the audio segment and the one or more first coefficients of the audio segment (as discussed in step 316) as the one or more first features, as described supra in Table 3.

A person having ordinary skill in the art will understand that the scope of the disclosure is not limited to determining the abovementioned one or more first features by using the one or more speech processing techniques as discussed supra. Further, the scope of the disclosure is not limited to determine the one or more first features of the first audio segment, the speech processing unit 210 may also determine the one or more first features of the remaining one or more audio segments.

At step 320, the one or more second features of the first audio segment are determined. In an embodiment, the speech processing unit 210, in conjunction with the processor 202 may be configured to determine the one or more second features for the first audio segment based at least on the one or more first features of the first audio segment.

In an embodiment, the one or more second features may comprise the following features:

Second Feature-1 ($f_1^{first}$)

The speech processing unit 210 may be configured to determine a second feature (second feature-1) of the first audio segment. In an embodiment, the speech processing unit 210 may utilize the one or more pitch values in the pitch contour of the first audio segment for determining the second feature-1. In an embodiment, the speech processing unit 210 may determine a first predefined percentile of the one or more pitch values in the first audio segment. In an embodiment, the first predefined percentile may correspond to the second feature-1 of the first audio segment. In an embodiment, the speech processing unit 210 may determine the second feature-1 by utilizing known in the art algorithms such as, but are not limited to, a nearest rank algorithm, and a linear interpolation between closest rank algorithm.

In an another embodiment, the speech processing unit 210 may normalize the one or more pitch values in the pitch contour of the first audio segment based on a F0 floor value, such that the F0 floor value corresponds to a mode value of the frequency histogram of the first audio segment. Thereafter, the speech processing unit 210 may determine the first predefined percentile of the normalized one or more pitch values.

For example, the speech processing unit 210 may determine a 5th percentile (n=5) of the normalized one or more pitch values, such that the 5th percentile corresponds to the first predefined percentile (i.e., the second feature-1 of the first audio segment). In an alternate embodiment, the speech processing unit 210 may also be configured to perform one or more logarithmic operations on the first predefined percentile to determine the second feature-1 of the first audio segment. In an embodiment, the value of 'n' may be defined by a user. In an alternate embodiment, the value of 'n' may be determined by the speech processing unit 210.

A person ordinary skilled in the art will understand that the above mentioned example is for illustrative purpose and should not be construed to limit the scope of the disclosure.

Second Feature-2 ($f_2^{first}$)

The speech processing unit 210 may be configured to determine a second feature (second feature-2) of the first audio segment. In an embodiment, the speech processing unit 210 may utilize the pitch contour of the first audio segment for determining the second feature-2 of the first audio segment. In an embodiment, the speech processing unit 210 may determine a first percentage of the one or more pitch values that lie in a first range of pitch values. In an embodiment, the first percentage of the one or more pitch values, determined by the speech processing unit 210, may correspond to the second feature-2 of the first audio segment. In an embodiment, the first range of pitch values may be defined by a user. In an alternate embodiment, the first range of pitch values may be determined by the speech processing unit 210.

For example, the speech processing unit 210 may be configured to determine the first percentage of the one or more pitch values, that are less than 0.75*[F0] or more than 1.5*[F0], where [F0] represents the F0 floor value. In this scenario, the first range of pitch values is [(p<0.75*[F0]) or (p>1.5*[F0])], where 'p' is any pitch value in the pitch contour of the first audio segment. Further, the speech processing unit 210 may determine the one or more pitch values, such as S={172, 225, 245, 278, 254, 300, 245, 370} in the pitch contour, and [F0]=245 (as determined by the speech processing unit 210). In this scenario, the first percentage (i.e., the second feature-2)=25%. In an alternate embodiment, the speech processing unit 210 may be configured to perform one or more mathematical operations such as, but not limited to, cube root, and logarithmic operations, on the first percentage to determine the second feature-2 of the first audio segment.

A person having ordinary skill in the art will understand that the abovementioned example is for illustrative purpose and should not be construed to limit the scope of the disclosure.

Second Feature-3 ($f_3^{first}$))

The speech processing unit 210 may determine a second feature (second feature-3) of the first audio segment. In an embodiment, the speech processing unit 210 may be configured to determine the second feature-3 for the first audio segment based on the pitch contour of the first audio segment. In an embodiment, the speech processing unit 210 may be configured to determine a first cumulative sum of the one or more pitch values in the pitch contour, at a temporal location of each of the one or more pitch values in the pitch contour. Thereafter, the speech processing unit 210 may be configured to determine a first temporal location in the pitch contour, where the first cumulative sum exceeds a first predefined percentage of a total sum of the one or more pitch values in the pitch contour. In an embodiment, a cumulative sum at a temporal location may correspond to a sum of pitch value at the temporal location under consideration and pitch values at the temporal location prior to the temporal location under consideration. In an embodiment, the first temporal location determined by the speech processing unit 210 may correspond to the second feature-3 of the first audio segment. In another embodiment, the speech processing unit 210 may determine the first cumulative sum, at a normalized temporal location of each of the one or more pitch values in the pitch contour. In an embodiment, the first predefined percentage may be defined by a user. In an alternate embodiment, the first predefined percentage may be determined by the speech processing unit 210.

In an exemplary implementation, the speech processing unit 210 may receive a first audio segment of duration 100 ms from the database server 104 and the speech processing unit 210 may determine the first predefined percentage, such as 20 percent. Table 8 illustrates the one or more pitch values in the pitch contour of the first audio segment and the temporal location of the one or more pitch values in the first audio segment.

TABLE 8

Illustration of the one or more pitch values, the corresponding temporal locations, and the cumulative sum at each normalized temporal location of the one or more pitch values in a first audio segment

| Pitch name | Pitch value (Hz) | Temporal location (MM:SS:mmm) | Normalized temporal location | Cumulative sum of one or more pitch values |
|---|---|---|---|---|
| F0(1) | 130 | 00:00:013 | 0.13 | 130 |
| F0(2) | 176 | 00:00:026 | 0.26 | 130 + 176 = 306 |
| F0(3) | 340 | 00:00:042 | 0.42 | 306 + 340 = 646 |
| F0(4) | 211 | 00:00:072 | 0.72 | 646 + 211 = 857 |
| F0(5) | 224 | 00:00:095 | 0.95 | 857 + 224 = 1081 |

Referring to Table 8, the speech processing unit 210 may determine that at 0.26 (i.e., a normalized temporal location) of the pitch contour, the cumulative sum of the pitch values F0(1) and F0(2) exceeds the first predefined percentage (i.e., 20 percent in the above example) of the total sum (i.e., 1081) of the one or more pitch values. Thus, 0.26 may correspond to the second feature-3 of the first audio segment. In an alternate embodiment, the speech processing unit 210 may further be configured to perform one or more logarithmic operations on the first normalized temporal location to determine the second feature-3 of the first audio segment.

A person ordinary skilled in the art will understand that the above mentioned example is for illustrative purpose and should not be construed to limit the scope of the disclosure.

Second Feature-4 ($f_4^{first}$)

The speech processing unit 210 may determine a second feature (second feature-4) of the first audio segment. In an embodiment, the speech processing unit 210 may be configured to determine the second feature-4 of the first audio segment based on the pitch contour of the first audio segment. In an embodiment, the speech processing unit 210 may be configured to determine a second temporal location in the pitch contour, where the first cumulative sum (as described supra) exceeds a second predefined percentage of a total sum of the one or more pitch values in the pitch contour. In an embodiment, the second temporal location determined by the speech processing unit 210 may correspond to the second feature-4 of the first audio segment. In an embodiment, the second predefined percentage may be defined by a user. In an alternate embodiment, the second predefined percentage may be determined by the speech processing unit 210.

Referring to Table 8, the speech processing unit 210 may determine the second predefined percentage, such as 40%. The speech processing unit 210 may determine that at 0.42 (i.e., a normalized temporal location) of the pitch contour, the cumulative sum of the pitch values F0(1), F0(2) and F0(3) exceeds the second predefined percentage (i.e., 40 percent) of the total sum (i.e., 1081) of the one or more pitch values. Thus, 0.42 may correspond to the second feature-4 of the first audio segment. In an alternate embodiment, the speech processing unit 210 may further be configured to perform one or more logarithmic operations on the second temporal location to determine the second feature-4 of the first audio segment.

A person having ordinary skilled in the art will understand that the abovementioned example is for illustrative purpose and should not be construed to limit the scope of the disclosure.

Second Feature-5 ($f_5^{first}$)

The speech processing unit 210 may determine a second feature (second feature-5) of the first audio segment. In an embodiment, the speech processing unit 210 may be configured to determine the second feature-5 of the first audio segment based on the pitch contour of the first audio segment. In an embodiment, the speech processing unit 210 may determine a set of pitch values from the pitch contour that exceeds a first factor of the F0 floor. Thereafter, the speech processing unit 210 may identify a pitch value from the set of pitch values that is temporally prior to all other pitch values in the set of pitch values. Further, the speech processing unit 210 may be configured to determine a third temporal location corresponding to the identified pitch value. In an embodiment, the third temporal location may correspond to the second feature-5 of the first audio segment. In another embodiment, the speech processing unit 210 may normalize the determined temporal location. In an embodiment, the first factor of the F0 floor may be defined by a user. In an alternate embodiment, a first factor of the F0 floor may be determined by the speech processing unit 210.

Referring to Table 8, the speech processing unit 210 may determine the first factor of the F0 floor, such as 1.5 (i.e., 1.5 of [F0]). The speech processing unit 210 may determine the third temporal location in the first audio segment, where the pitch value F0(3) exceeds 1.5 of [F0] for a first time, as 0.42. In an embodiment, 0.42 may correspond to the second feature-5 ($f_5^{first}$) of the first audio segment. In an alternate embodiment, the speech processing unit 210 may further be configured to perform the one or more logarithmic operations on the third temporal location to determine the second feature-5 of the first audio segment.

A person ordinary skilled in the art will understand that the above mentioned example is for illustrative purpose and should not be construed to limit the scope of the disclosure.

Second Feature-6 ($f_6^{first}$)

The speech processing unit 210 may determine a second feature (second feature-6) of the first audio segment. In an embodiment, the speech processing unit 210 may determine the second feature-6 feature based on the pitch contour of the first audio segment. In an embodiment, the speech processing unit 210 may determine a fourth temporal location in the pitch contour of the first audio segment corresponding to a maximum pitch value in the pitch contour. In an embodiment, the fourth temporal location may correspond to the second feature-6 of the first audio segment. In another embodiment, the speech processing unit 210 may normalize the fourth temporal location. The speech processing unit 210 may determine the second feature-6 ($f_6^{first}$) by using equation 1, shown below:

$$f_6^{first} = \log\left(\frac{k'}{N+1}\right) \tag{1}$$

where, k': corresponds to the temporal location of the maximum pitch value, in the pitch contour, of the first audio segment; and N: corresponds to a sum of the count of the one or more voiced frames and the count of one or more unvoiced frames in the first audio segment.

The determination of the second feature-6 has been explained with reference to FIG. 5.

Figure 5:
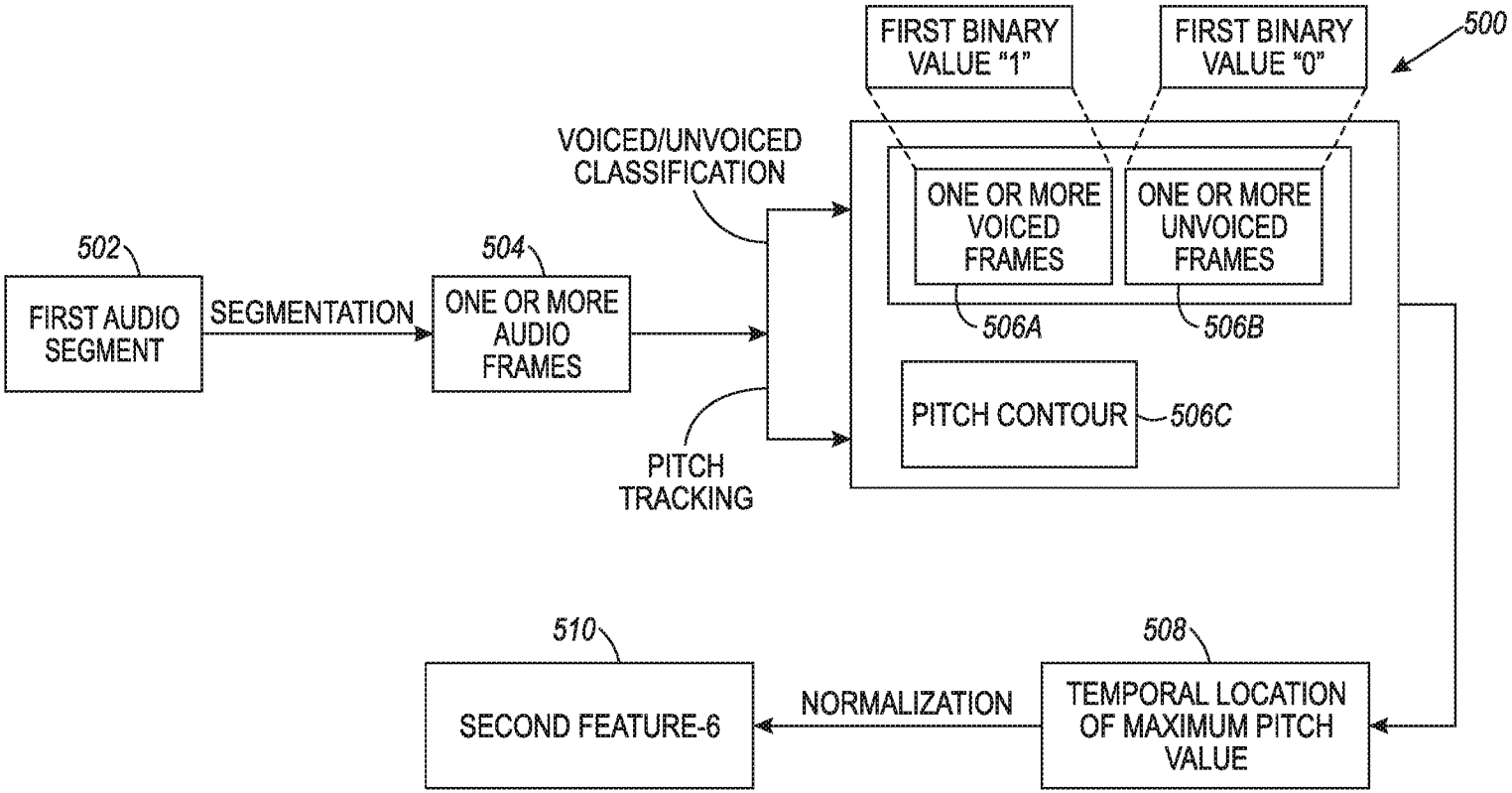
FIG. 5 illustrates an exemplary scenario to determine at least a second feature (i.e., second feature-6) of one or more second features of a first audio segment, in accordance with at least one embodiment.

FIG. 5 is a block diagram 500 that depicts an exemplary scenario to determine the second feature-6 of a first audio segment, in accordance with at least one embodiment.

Referring to FIG. 5, the first audio segment (depicted by 502) is segmented by the segmentation unit 208 to determine the one or more audio frames (depicted by 504). Thereafter, the one or more audio frames (depicted by 504) are processed by using the voiced/unvoiced classification technique and the pitch tracking technique for determining the one or more voiced frames (depicted by 506*a*), the one or more unvoiced frames (depicted by 506*b*) and the pitch contour (depicted by 506*c*) of the first audio segment. In an embodiment, the speech processing unit 210 may assign the first binary value "1" to the one or more voiced frames and the first binary value "0" to the one or more unvoiced frames. In an embodiment, the one or more voiced frames (depicted by 506*a*), the one or more unvoiced frames (depicted by 506*b*) and the pitch contour (depicted by 506*c*) may correspond to the one or more first features (as described supra in Table 3) of the first audio segment. Further, based on the pitch contour, the fourth normalized temporal location corresponding to the maximum pitch value (depicted by 508) is determined. Further, based on the fourth normalized temporal location of the maximum pitch value (depicted by 508), the second feature-6 (depicted by 510) is determined (by use of equation 1). In an alternate embodiment, the speech processing unit 210 may perform the one or more logarithmic operations on the fourth normalized temporal location to determine the second feature-6 (depicted by 510).

Referring to FIG. 3B, in Table 8 the speech processing unit 210 may determine the fourth temporal location corresponding to the maximum pitch value F0(3), as 0.42. In an embodiment, 0.42 may correspond to the second feature-6 of the first audio segment.

A person having ordinary skilled in the art will understand that the above mentioned example is for illustrative purpose and should not be construed to limit the scope of the disclosure.

Second Feature-7 ($f_7^{first}$)

The speech processing unit 210 may determine a second feature (second feature-7) of the first audio segment. In an embodiment, the speech processing unit 210 may be configured to determine the second feature-7 of the first audio segment based on the one or more continuous voiced frames and the third time duration associated with each of the one or more continuous voiced frames. In an embodiment, the speech processing unit 210 may be configured to determine an average time duration of the one or more continuous voiced frames in the first audio segment. In an embodiment, the average time duration of the one or more continuous voiced frames, determined by the speech processing unit 210, may correspond to the second feature-7 of the first audio segment.

In an exemplary implementation, the speech processing unit 210 may determine six continuous voiced frames in a first audio segment, as shown in Table 9, wherein the time duration of the first audio segment is 500 ms. Table 9 illustrates the one or more continuous voiced frames and the corresponding third time duration.

TABLE 9

Illustration of the one or more continuous voice frames and the corresponding third time duration, in the first audio segment.

| Continuous Voiced frames | Third Time duration |
|---|---|
| CF1 | 30 ms |
| CF2 | 80 ms |
| CF3 | 40 ms |
| CF4 | 50 ms |
| CF5 | 70 ms |
| CF6 | 50 ms |

Referring to Table 9, the speech processing unit 210 may determine the average time duration of the one or more continuous voiced frames as 53.33 ms. With respect to the illustrated example as shown in Table 9, 53.33 ms may correspond to the second feature-7 of the first audio segment. In an alternate embodiment, the speech processing unit 210 may perform the one or more logarithmic operations on the average time duration of the one or more continuous voiced frames to determine the second feature-7 of the first audio segment.

A person having ordinary skill in the art will appreciate that the abovementioned exemplary implementation is provided for illustrative purposes and should not be construed to limit the scope of the disclosure.

Second Feature-8 ($f_8^{first}$)

The speech processing unit 210 may determine a second feature (second feature-8) of the first audio segment. In an embodiment, the speech processing unit 210 may be configured to determine the second feature-8 of the first audio segment based on the one or more continuous voiced frames of the first audio segment and the third time duration corresponding to the one or more continuous voiced frames. In an embodiment, the speech processing unit 210 may determine the third time duration of temporally last continuous voiced frame in the one or more continuous voiced frames of the first audio segment. In an embodiment, the third time duration of the last continuous voiced frame may correspond to the second feature-8 of the first audio segment.

Referring to Table 9, the speech processing unit 210 may determine the third time duration of the last continuous voiced frame (CF6) in the first audio segment, as 50 ms. In an embodiment, the third time duration of the last continuous voiced frame (50 ms) corresponds to the second feature-8 of the first audio segment. In an alternate embodiment, the speech processing unit 210 may perform the one or more logarithmic operations on the third time duration of the last continuous voiced frame to obtain the second feature-8 of the first audio segment.

A person having ordinary skill in the art will appreciate that the abovementioned exemplary implementation is provided for illustrative purposes and the scope of the disclosure is not limited to determining the second feature-8 by using the abovementioned technique.

Second Feature-9 ($f_9^{first}$)

The speech processing unit 210 may determine a second feature (second feature-9) of the first audio segment. In an embodiment, the speech processing unit 210 may determine the second feature-9 based on the one or more continuous voiced frames in the first audio segment. In an embodiment, the speech processing unit 210 may determine a count of the one or more continuous voiced frames in the first audio segment. In an embodiment, the count of the one or more continuous voiced frames may correspond to the second feature-9 of the first audio segment.

Referring to Table 9, the speech processing unit 210 may determine the count of the one or more continuous voiced frames in the first audio segment as 6. In an embodiment, the second feature-9, determined by the speech processing unit 210, corresponds to 6. In an alternate embodiment, the speech processing unit may perform the one or more logarithmic operations on the count of the one or more continuous voiced frames to determine the second feature-9 of the first audio segment.

A person having ordinary skill in the art will appreciate that the abovementioned exemplary implementation is provided for illustrative purposes and the scope of the disclosure is not limited to determining the second feature-9 feature by using the abovementioned technique.

Second Feature-10 ($f_1^{first}$)

The speech processing unit 210 may determine a second feature (second feature-10) of the first audio segment. In an embodiment, the speech processing unit 210 may be configured to determine the second feature-10 of the first audio segment based on the one or more continuous voiced frames in the first audio segment. In an embodiment, the speech processing unit 210 may determine a count of the one or more continuous voiced frames per unit of time (e.g., per second) in the first audio segment. In an embodiment, the second feature-10 may correspond to the determined count of the one or more continuous voiced frames per unit of time in the first audio segment.

Referring to Table 9, the speech processing unit 210 may determine the count of the one or more continuous voiced frames per second in the first audio segment as 18.75. In an embodiment, 18.75 corresponds to the second feature-10 of the first audio segment. In an alternate embodiment, the speech processing unit 210 may perform the one or more logarithmic operations on the count of the one or more continuous voiced frames per unit of time to determine the second feature-10 of the first audio segment.

A person having ordinary skill in the art will appreciate that the abovementioned exemplary implementation is provided for illustrative purposes and the scope of the disclosure is not limited to determining the second feature-10 by using the abovementioned techniques.

Second Feature-11 ($f_{11}^{first}$)

The speech processing unit 210 may determine a second feature (second feature-11) of the first audio segment. In an embodiment, the speech processing unit 210 may be configured to determine the second feature-11 of the first audio segment based on the pitch contour of the first audio segment. To determine the second feature-11, the speech processing unit 210 may determine one or more second coefficients for each of the one or more continuous voiced frames. The speech processing unit 210 may determine the one or more second coefficients by use of one or more known transformation techniques on the pitch contour of the first audio segment. Examples of the one or more transformation techniques may be based on at least a Discrete Cosine Transform (DCT), a Discrete Fourier Transform, and/or the like. Further, the speech processing unit 210 may determine a first percentage energy associated with the one or more second coefficients. In an embodiment, the speech processing unit 210 may determine the first percentage energy by use of a predefined count of second coefficients from the one or more second coefficients. In an exemplary scenario, the count may correspond to three. The speech processing unit 210 may utilize one or more known in the art energy computation techniques such as, but are not limited to, a short time energy computation technique. Thereafter, the speech processing unit 210 may identify a minimum first percentage energy among the first percentage energy associated with each of the one or more continuous voiced frames. In an embodiment, the minimum first percentage energy, determined by the speech processing unit 210, may correspond to the second feature-11 of the first audio segment. In an alternate embodiment, the speech processing unit 210 may perform the one or more logarithmic operations on the determined minimum first percentage energy to determine the second feature-11 of the first audio segment.

In an embodiment, the speech processing unit 210 may store the one or more second coefficients and the one or more first percentage energy associated with each of the one or more continuous voiced frames in the memory 204, or the database server 104, via the network 106.

Second Feature-12 ($f_{12}^{first}$)

The speech processing unit 210 may determine a second feature (second feature-12) of the first audio segment. In an embodiment, the speech processing unit 210 may be configured to determine the second feature-12 based on the first percentage energy (as discussed supra). To determine the second feature-12, in an embodiment, the speech processing unit 210 may determine the first percentage energy associated with the temporally last continuous voiced frame in the one or more continuous voiced frames of the first audio segment. In an embodiment, the first percentage energy associated with the last continuous voiced frame may correspond to the second feature-12 of the first audio segment. In an alternate embodiment, the speech processing unit 210 may perform the one or more logarithmic operations on the first percentage energy associated with the last continuous voiced frame to determine the second feature-12 of the first audio segment.

Second Feature-13 ($f_{13}^{first}$)

The speech processing unit 210 may determine a second feature (second feature-13) of the first audio segment. In an embodiment, the speech processing unit 210 may determine the second feature-13 of the first audio segment based on the one or more audio frames. As discussed supra, the one or more audio frames of the first audio segment are further identified as the one or more voiced frames and the one or more unvoiced frames. To determine the second feature-13, the speech processing unit 210 may be configured to determine a first cross-correlation between the one or more audio frames that are temporally adjacent to each other. In an embodiment, the adjacent one or more audio frames may correspond to at least one of: two voiced frames, a voiced frame and an unvoiced frame, or two unvoiced frames of the first audio segment. The speech processing unit 210 may use known in the art techniques for determining the first cross-correlation between the one or more audio frames. Further, the speech processing unit 210 may determine a percentage of voiced frames in the one or more voiced frames, such that the first cross-correlation of the voiced frames may be greater than or equal to a first predefined value. In an embodiment, the determined percentage of the voiced frames may correspond to the second feature-13 of the first audio segment. In an embodiment, the first predefined value may be defined by a user. In an alternate embodiment, the first predefined value may be determined by the speech processing unit 210. In an embodiment, the speech processing unit 210 may normalize the first cross-correlation.

For example, the speech processing unit 210 may determine the first normalized cross-correlation between eight audio frames of a first audio segment, such as $N_{12}=0.3$, $N_{23}=0.27$, $N_{34}=0.97$, $N_{45}=0.31$, $N_{56}=0.56$, $N_{67}=0.92$, and $N_{78}$=0.23 and the first predefined value, such as 0.9. Here, frame 1, frame 3, frame 4, frame 6 and frame 7 are the one or more voiced frames, and frame 2, frame 5, and frame 8 are the one or more unvoiced frames. Thus, the speech processing unit 210 determines that the voiced frames (frame 3 and frame 6) of the one or more voiced frames have the first normalized cross-correlation greater than the first predefined value (0.9). Therefore, the speech processing unit 210 determines the percentage of the voiced frames, such that the first normalized cross-correlation of the voiced frames is greater than or equal to the first predefined value (0.9), as 40%. In an embodiment, the percentage of the one or more voiced frames with first normalized cross-correlation greater than or equal to the first predefined value (i.e., 40%) corresponds to the second feature-13 of the first audio segment. In an alternate embodiment, the speech processing unit 210 may further process the percentage of the one or more voiced frames with first normalized cross-correlation greater than the first predefined value, by performing the one or more logarithmic operations, to determine the second feature-13.

A person having ordinary skill in the art will appreciate the abovementioned technique for determining the second feature-13 is provided for illustrative purposes and is not construed to limit the scope of this disclosure.

Second Feature-14 ($f_{14}^{first}$)

The speech processing unit 210 may determine a second feature (second feature-14) of the first audio segment. In an embodiment, the speech processing unit 210 may determine the second feature-14 of the first audio segment based on the one or more voiced frames in the two temporally last continuous voiced frames. To determine the second feature-14, the speech processing unit 210 may be configured to determine a second cross-correlation between the adjacent one or more voiced frames in the two temporally last continuous voiced frames in the one or more continuous voiced frames. In an embodiment, the second normalized cross-correlation, determined by the speech processing unit 210, may correspond to the second feature-14 of the first audio segment. In another embodiment, the speech processing unit 210 may further be configured to normalize the second cross-correlation between the adjacent one or more voiced frames in the two temporally last continuous voiced frames. In an embodiment, the speech processing unit 210 may determine a percentage of the one or more voiced frames in the last two continuous voiced frames with the second cross-correlation greater than a second predefined value. In an embodiment, the second percentage of the one or more voiced frames in the two temporally last continuous voiced frames, determined by the speech processing unit 210, may correspond to the second feature-14 of the first audio segment. In an embodiment, the second predefined value may be defined by a user. In an alternate embodiment, the second predefined value may be determined by the speech processing unit 210.

For example, the speech processing unit 210 may identify the two temporally last continuous voiced frames, such as $CF_7$ (comprising two voiced frames) and CF8 (comprising three voiced frames). Further, the speech processing unit 210 may determine the normalized second cross-correlation between the voiced frames in the two temporally last continuous voiced frames of a first audio segment. For example, let the normalized second cross-correlation between adjacent voiced frames in the two temporally last continuous voiced frames of a first audio segment be as $V_{12}$=0.932, $V_{23}$=0.66, $V_{45}$=0.69, and the second predefined value be 0.9. In this scenario, the speech processing unit 210 may determine the second percentage of the one or more voiced frames in the two temporally last continuous voiced frames, such that the normalized second cross-correlation greater than the second predefined value (0.9), as 20%. Thus, the second feature-14 corresponds to 20%. In an alternate embodiment, the speech processing unit 210 may be configured to perform the one or more mathematical operations such as, but not limited to, a cube root, or a fifth root, on the determined second percentage for determining the second feature-14 of the first audio segment.

A person having ordinary skill in the art will appreciate the abovementioned technique for determining the second percentage feature is provided for illustrative purposes and is not construed to limit the scope of this disclosure.

Second Feature-15 ($f_{12}^{first}$)

The speech processing unit 210 may determine a second feature (second feature-15) of the first audio segment. In an embodiment, the speech processing unit 210 may be configured to determine the second feature-15 based on the one or more continuous voiced frames in the first audio segment. As discussed supra, each of the one or more continuous voiced frames comprises the one or more voiced frames that are temporally adjacent. Each voiced frame in a continuous voiced frame has a pitch value. In an embodiment, the speech processing unit 210 may be configured to determine a maximum pitch value and a minimum pitch value for each of the one or more continuous voiced frames. Further, the speech processing unit 210 may determine a pitch range for each of the one or more continuous voiced frames based on the maximum pitch value and the minimum pitch value of the corresponding continuous voiced frame. In an embodiment, the pitch range may correspond to a difference between the maximum pitch value and the minimum pitch value in the continuous voiced frame. Thereafter, the speech processing unit 210 may identify a minimum pitch range among the pitch range associated with each of the one or more continuous voiced frames. In an embodiment, the minimum pitch range identified by the speech processing unit 210 may correspond to the second feature-15.

In another embodiment, the speech processing unit 210 may be configured to determine the pitch range based on the normalized one or more pitch values, such that the one or more pitch values are normalized by the F0 floor. In an embodiment, the speech processing unit 210 may be configured to store the pitch range of each of the one or more continuous voiced frames in the database server 104, via the network 106.

In an exemplary implementation, the speech processing unit 210 may determine the one or more pitch values corresponding to each voiced frame in the continuous voiced frames, such as (CF1, CF2, CF3, and CF4), CF1={220, 225, 200, 221}, CF2={224, 220, 225, 228}, CF3={219, 217, 223, 218}, and CF4={227, 221, 217, 215}. As determined by the speech processing unit 210, the pitch range of CF1 is 25 Hz, CF2 is 8 Hz, CF3 is 6 Hz and CF4 is 12 Hz. The speech processing unit 210 may identify 6 Hz as the minimum pitch range (corresponding to CF3). Thus, the speech processing unit 210 determines 6 Hz as the second feature-15 of the first audio segment. In an alternate embodiment, the speech processing unit 210 may be configured to perform the one or more mathematical operations such as, but not limited to, cube root, fifth root, on the determined minimum pitch range for determining the second feature-15 of the first audio segment.

A person having ordinary skill in the art will appreciate that the above mentioned exemplary scenario is for illustrative purpose and should not be construed to limit the scope of the disclosure.

Second Feature-16 ($f_{16}^{first}$)

The speech processing unit 210 may determine a second feature (second feature-16) of the first audio segment. In an embodiment, the speech processing unit 210 may be configured to identify the pitch range (as discussed supra in the second feature-17) of the temporally last continuous voiced frame in the one or more continuous voiced frames of the first audio segment. In an embodiment, the pitch range of the temporally last continuous voiced frame, identified by the speech processing unit 210, may correspond to the second feature-16 of the first audio segment.

In an exemplary implementation, the speech processing unit 210 may determine the pitch range of the one or more continuous voiced frames of the first audio segment, such as CF1→25 Hz, CF2→8 Hz, CF3→6 Hz and CF4→12 Hz, such that CF4 is the temporally last continuous voiced frame. Thus, the speech processing unit 210 may determine the pitch range of the temporally last continuous voiced frame as 12 Hz, such that 12 Hz corresponds to the second feature-16 of the first audio segment. In an alternate embodiment, the speech processing unit 210 may be configured to perform the one or more mathematical operations such as, but not limited to, cube root, fifth root, on the determined pitch range, of the temporally last continuous voiced frame, for determining the second feature-15 of the first audio segment.

A person having ordinary skill in the art will appreciate that the abovementioned exemplary implementation is for illustrative purpose and should not be construed to limit the scope of the disclosure.

Second Feature-17 ($f_{17}^{first}$)

The speech processing unit 210 may determine a second feature (second feature-17) of the first audio segment. In an embodiment, the speech processing unit 210 may be configured to determine the second feature-17 of the first audio segment based on the one or more continuous voiced frames. For determining the second feature-17, the speech processing unit 210 may be configured to determine a standard deviation of the one or more pitch values of each of the one or more continuous voiced frames. Further, the speech processing unit 210 may be configured to identify a minimum standard deviation among the standard deviation associated with each of the one or more continuous voiced frames. In an embodiment, the minimum standard deviation, identified by the speech processing unit 210 may correspond to the second feature-17 of the first audio segment. In another embodiment, the speech processing unit 210 may determine the standard deviation of the normalized one or more pitch values of each of the one or more continuous voiced frames. In an embodiment, the speech processing unit 210 may store the standard deviation of each of the one or more continuous voiced frames in the database server 104, over the network 106.

In an exemplary implementation, the speech processing unit 210 may determine the one or more pitch values in the continuous voiced frames (CF1, CF2, CF3, and CF4), such as CF1={220, 225, 200, 221}, CF2={224, 220, 225, 228}, CF3={219, 217, 223, 218}, and CF4={227, 221, 217, 215}. The normalized one or more pitch values in the continuous voiced frames (CF1, CF2, CF3, and CF4) are CF1={1.01, 1.039, 0.923, 1.023}, CF2={1, 0.982, 1.004, 1.017}, CF3={1, 0.99, 1.01, 0.995}, CF4={1.031, 1.004, 0.986, 0.977} (normalized based on the F0 floor value). The standard deviation of the normalized one or more pitch values of CF1 is 0.044, CF2 is 0.0125, CF3 is 0.0074 and CF4 is 0.0206. The speech processing unit 210 may determine the minimum first standard deviation as 0.0074. Therefore, 0.0074 may correspond to the second feature-17 of first audio segment. In an alternate embodiment, the speech processing unit 210 may be configured to perform the one or more mathematical operations such as, but not limited to, cube root, and fifth root, on the determined minimum first standard deviation for determining the second feature-17 of the first audio segment.

A person having ordinary skill in the art will appreciate that the abovementioned exemplary implementation is for illustrative purpose and should not be construed to limit the scope of the disclosure.

Second Feature-18 ($f_{18}^{first}$)

The speech processing unit 210 may determine a second feature (second feature-18) of the first audio segment. In an embodiment, the speech processing unit 210 may be configured to determine the second feature-18 of the first audio segment based on the one or more pitch values in the pitch contour of the first audio segment. For determining the second feature-18, the speech processing unit 210 may be configured to determine a standard deviation of the one or more pitch values in the pitch contour of the first audio segment. In an embodiment, the standard deviation of the one or more pitch values determined by the speech processing unit 210 may correspond to the second feature-18 of the first audio segment. In another embodiment, the speech processing unit 210 may determine the standard deviation of the normalized one or more pitch values in the pitch contour of the first audio segment.

In an exemplary implementation, the speech processing unit 210 may determine the one or more pitch values in the pitch contour of the first audio segment, such as 220, 225, 200, and 221. The normalized one or more pitch values are 1.01, 1.039, 0.923, and 1.023 (normalized by the F0 floor value). The standard deviation of the normalized one or more pitch values, as determined by the speech processing unit 210, is 0.044. Thus, the speech processing unit 210 may determine the second feature-18 as 0.044. In an alternate embodiment, the speech processing unit 210 may be configured to perform the one or more mathematical operations such as, but not limited to, cube root, and fifth root, on the determined second standard deviation of the one or more pitch values for determining the second feature-18 of the first audio segment.

A person having ordinary skill in the art will appreciate that the abovementioned exemplary implementation is for illustrative purpose and should not be construed to limit the scope of the disclosure.

Second Feature-19 ($f_{19}^{first}$)

The speech processing unit 210 may determine a second feature (second feature-19) of the first audio segment. In an embodiment, the speech processing unit 210 may be configured to determine the second feature-19 of the first audio signal based on the standard deviation of the pitch values, as determined supra in the second feature-17 of the first audio segment. For determining the second feature-19, the speech processing unit 210 may be configured to identify the standard deviation corresponding to the temporally last continuous voiced frame of the one or more continuous voiced frames of the first audio segment. In an embodiment, the standard deviation corresponding to the last continuous voiced frame, determined by the speech processing unit 210, may correspond to the second feature-19 of the first audio segment.

In an exemplary scenario, the speech processing unit 210 may determine the first standard deviation of the pitch values such as for CF1→0.044, CF2→0.0125, CF3→0.0074 and CF4→0.0206, where CF1, CF2, CF3, and CF4 are the one or more continuous voiced frames in the first audio segment. Then, the speech processing unit 210 may determine the second feature-19 as 0.0206, i.e., the first standard deviation of the one or more pitch values of the temporally last continuous voiced frame. In an alternate embodiment, the speech processing unit 210 may be configured to perform the one or more mathematical operations such as, but not limited to, cube root, and fifth root, on the determined first standard deviation of the one or more pitch values of the last continuous voiced frame for determining the second feature-19 of the first audio segment.

A person having ordinary skill in the art will appreciate that the abovementioned exemplary implementation is for illustrative purpose and should not be construed to limit the scope of the disclosure.

Second Feature-20 ($f_{20}^{first}$)

The speech processing unit 210 may determine a second feature (second feature-20) of the first audio segment. In an embodiment, the speech processing unit 210 may be configured to determine the second feature-20 based on the first audio segment and the one or more non-speech frames in the first audio segment. In an embodiment, one or more of the one or more non-speech frames may be associated with the pause. In an embodiment, the pause may correspond to a single non-speech frame. In an alternate embodiment, the pause may correspond to the set of non-speech frames (temporally adjacent to each other) that collectively may be of duration greater or equal to a predefined duration. In an embodiment, the predefined duration may be specified by a user. In an alternate embodiment, the speech processing unit 210 may determine the predefined duration.

In an embodiment, the speech processing unit 210 may be configured to identify a temporally first non-speech frame (i.e., the pause) in the one or more non speech frames based on the timestamp associated with each of the one or more non-speech frames. Further, the speech processing unit 210 may be configured to identify a start time instant of the temporally first non-speech frame from the corresponding timestamp. Thereafter, the speech processing unit 210 may determine a time duration of the first audio segment elapsed before the start time instant of the temporally first non-speech frame. In an embodiment, the time duration of the first audio segment elapsed before the start time instant of the non-speech frame, as identified by the speech processing unit 210, may correspond to the second feature-20 of the first audio segment. In another embodiment, the speech processing unit 210 may normalize the time duration of the first audio segment elapsed before the start time instant of the temporally first non-speech frame for determining the second feature-20 of the first audio segment.

In an exemplary scenario, the speech processing unit 210 may receive a first audio segment, such that the first audio segment begins at a timestamp of 15:45:000 of the audio signal and one or more non-speech frames (NS1, NS2, NS3, and NS4) in the first audio segment begins at timestamp of NS1→16:34:000, NS2→16:57:000, NS3→17:12:000, and NS4→17:21:000. The speech processing unit 210 identifies NS1 as the temporally first non-speech frame in the one or more non-speech frames (based on the timestamp associated to the one or more non-speech frames). Further, the speech processing unit 210 may determine the time duration of the first audio segment elapsed before the start time instant of the temporally first non-speech frame by taking a difference between the timestamps associated with the first audio segment and the non-speech frame i.e., (16:34:000-15:45:000=49 seconds). Thus, the determined time duration (i.e., 49 seconds) may correspond to the second feature-20 of the first audio segment.

A person having ordinary skill in the art will understand the aforementioned exemplary scenario is for illustrative purpose and should not be construed to limit the scope of the disclosure.

In another embodiment, the speech processing unit 210 may be configured to identify one or more sets of temporally adjacent one or more non-speech frames in the first audio segment. Thereafter, the speech processing unit 210 may determine a collective time duration of each of the one or more sets of temporally adjacent one or more non-speech frames based on the timestamp associated with each non-speech frame in each of the one or more sets of temporally adjacent one or more non-speech frames. Further, the speech processing unit 210 may compare the collective time duration of each of the one or more sets of temporally adjacent one or more non-speech frames with the predefined duration. In an embodiment, the speech processing unit 210 may be configured to identify one or more sets of temporally adjacent one or more non-speech frames with the collective time duration greater than or equal to the predefined duration. In an embodiment, the identified one or more sets of temporally adjacent one or more non-speech frames with the collective time duration greater than or equal to the predefined duration may correspond to one or more pauses. Further, the speech processing unit 210 may be configured to determine a temporally first pause in the one or more pauses. Furthermore, the speech processing unit 210 may determine a start time instant of a temporally first non-speech frame in the temporally first pause (i.e., start time instant of the temporally first pause). Thereafter, the speech processing unit 210 may be configured to determine the time duration of the first audio segment elapsed before the start time instant of the temporally first pause. In an embodiment, the time duration of the first audio segment elapsed before the start time instant of the temporally first pause may correspond to the second feature-20 of the first audio segment.

For example, the speech processing unit 210 may identify a first set of temporally adjacent one or more non-speech frames, such that the first set of temporally adjacent one or more non-speech frames comprises frame 3 (time duration 30 ms), frame 4 (time duration 30 ms) and frame 5 (time duration 30 ms), with the collective time duration of 50 ms (overlap period between adjacent non-speech frames—20 ms), a second set of temporally adjacent one or more non-speech frames, such that the second set of temporally adjacent one or more non-speech frames comprises frame 11, frame 12, frame 13, frame 14, frame 15, frame 16, frame 17 and frame 18, with the collective time duration of 100 ms (overlap period between adjacent non-speech frames—20 ms), and the predetermined duration as 100 ms. In this scenario, the collective time duration of the first set of temporally adjacent one or more non-speech frames is neither greater nor equal to the predetermined duration, but the collective time duration corresponding to the second set of temporally adjacent one or more non-speech frames, i.e., 100 ms is equal to the predetermined duration. Therefore, the second set of temporally adjacent one or more non-speech frames may be identified as the pause by the speech processing unit 210. After the identification of the pause, the speech processing unit 210 may identify the start time instant of the temporally first non-speech frame in the pause (i.e., the start time of the frame 11) as 17:48:000. Thereafter, the speech processing unit 210 may identify the time duration of the first audio segment, with start time instant as 15:45:000, elapsed before the start time instant of the temporally first non-speech frame in the pause as 2 minutes and 3 seconds (i.e., the second feature-20 of the first audio segment). In an alternate embodiment, the speech processing unit 210 may perform the one or more mathematical operations on the time duration of the first audio segment elapsed before the identified start time instant of the temporally first non-speech frame, such as, but not limited, to cube root, and fifth root to determine the second feature-20 of the first audio segment.

A person having ordinary skill in the art will understand that the aforementioned exemplary scenario is for illustrative purpose and should not be construed to limit the scope of the disclosure.

Second Feature-21 ($f_{21}^{first}$)

The speech processing unit 210 may determine a second feature (second feature-21) of the first audio segment. In an embodiment, the speech processing unit 210 may be configured to determine the second feature-21 based on the first time duration of the first audio segment and the first time duration of a second audio segment, such that the second audio segment is temporally subsequent and adjacent to the first audio segment. The speech processing unit 210 may determine the second feature-21 ($f_{21}^{first}$) of the first audio segment by using equation 2 shown below:

$$f_{21}^{first} = \log_{10}\frac{t_{current}}{t_{next}} \tag{2}$$

where, $t_{current}$ is the first time duration of the first audio segment; and $t_{next}$ is the first time duration of the second audio segment.

In an alternate embodiment, the speech processing unit 210 may be configured to perform one or more mathematical operations such as, but not limited to, cube root, logarithmic operations, on $f_{22}^{first}$ to determine the second feature-21 of the first audio segment.

A person having ordinary skill in the art will understand that the scope of determining the second feature-21 of the first audio segment is not limited to the aforementioned equation, i.e., equation 2.

Second Feature-22 ($f_{22}^{first}$)

The speech processing unit 210 may determine a second feature (second feature-22) of the first audio segment. In an embodiment, the speech processing unit 210 may be configured to determine the second feature-22 based on the first time duration of the first audio segment and the first time duration of a second audio segment, such that the second audio segment is temporally prior and adjacent to the first audio segment. The speech processing unit 210 may determine the second feature-22 ($f_{22}^{first}$) of the first audio segment by using equation 3, shown below:

$$f_{22}^{first} = \log_{10}\frac{t_{current}}{t_{previous}} \tag{3}$$

where, $t_{current}$ is the first time duration corresponding to the first audio segment; and $t_{previous}$ is the first time duration corresponding to the second audio segment.

In an alternate embodiment, the speech processing unit 210 may be configured to perform one or more mathematical operations such as, but not limited to, cube root, and logarithmic operations, on $f_{23}^{first}$ to determine the second feature-22 of the first audio segment.

A person having ordinary skill in the art will understand that the scope of determining the second feature-22 of the first audio segment is not limited to the aforementioned equation, i.e., equation 3.

Second Feature-23 ($f_{21}^{first}$)

The speech processing unit 210 may determine a second feature (second feature-23) of the first audio segment. In an embodiment, the speech processing unit 210 may determine the second feature-23 of the first audio segment based on a count of the one or more speech frames and a count of the one or more non-speech frames in the first audio segment. For the determination of the count of the one or more speech frames and the count of the one or more non-speech frames in the first audio segment, the speech processing unit 210 may utilize the second binary value associated with the one or more audio frames of the first audio segment. The speech processing unit 210 may determine the second feature-23 ($f_{23}^{first}$) of the first audio segment based on the equation 4, shown below:

$$f_{23}^{first} = \frac{N_{speech}}{N_{non\text{-}speech}} \tag{4}$$

where, $N_{speech}$ is the count of the one or more speech frames in the first audio segment (i.e., the one or more audio frames with the second binary value as "1"); and $N_{non\text{-}speech}$ is the count of the one or more non-speech frames (i.e., the one or more audio frames with the second binary value as "0") in the first audio segment.

In an alternate embodiment, the speech processing unit 210 may be configured to perform one or more mathematical operations such as, but not limited to, cube root, logarithmic operations, on the $f_{23}^{first}$ value to determine the second feature-23 of the first audio segment.

A person having ordinary skill in the art will appreciate that the scope of the disclosure is not limited to determining the second feature-23 based on the abovementioned technique.

Second Feature-24 ($f_{24}^{first}$)

The speech processing unit 210 may determine a second feature (second feature-24) of the first audio segment. In an embodiment, the speech processing unit 210 may be configured to determine the second feature-24 of the first audio segment based on a count of the one or more continuous speech frames in the first audio segment. For example, referring to Table 7, the count of continuous speech frames is 2. Thus, the speech processing unit 210 determines second feature-24 as 2.

In an alternate embodiment, the speech processing unit 210 may be configured to perform one or more mathematical operations such as, but not limited to, cube root, and logarithmic operations, on the determined count of continuous speech frames in the first audio segment to determine the second feature-24 of the first audio segment.

A person having ordinary skill in the art will appreciate that the scope of the disclosure is not limited to determining the second feature-24 based on the abovementioned example.

Second Feature-25 ($f_{25}^{first}$)

The speech processing unit 210 may determine a second feature (second feature-25) of the first audio segment. In an embodiment, the speech processing unit 210 may be configured to determine the second feature-25 of the first audio segment based on the first audio segment and a second audio segment, such that the second audio segment is temporally adjacent and subsequent to the first audio segment.

In an embodiment, the speech processing unit 210 may be configured to determine a first pause duration for the first audio segment based on the timestamp of the first audio segment and the timestamp of the second audio segment. In an embodiment, the first pause duration may correspond to a difference between a start time instant of the second audio segment and an end time instant of the first audio segment, For determining the first pause duration, the speech processing unit 210 may be configured to identify the end time instant of the first audio segment from the corresponding timestamp and the start time instant of the second audio segment from the corresponding timestamp. Further, the speech processing unit 210 may determine the difference between the start time of the second audio segment and the end time of the first audio segment (i.e., the first pause duration). In an embodiment, the first pause duration determined by the speech processing unit 210 may correspond to the second feature-25 of the first audio segment.

For example, the speech processing unit 210 may identify the end time instant of a first audio segment, such as 15:45:000 and the start time instant of the second audio segment, such as 15:47:000. Thus, the speech processing unit 210 may identify the first pause duration as 2 seconds that corresponds to the second feature-25 of the first audio segment.

A person having ordinary skill in the art will understand that the aforementioned example is for illustrative purpose and should not be construed to limit the scope of the disclosure.

As discussed supra, the one or more audio segments comprise an uninterrupted audio corresponding to a user. In an embodiment, the one or more audio segments may comprise a speech conversation between two users, such that the first audio segment may correspond to the first user of the two users and the second audio segment may correspond to the second user of the two users. Further, after the first user stops speaking there may exist a silence/noise before the second user starts speaking. In an embodiment, the time duration corresponding to the silence/noise between the first audio segment and the second audio segment, determined by the speech processing unit 210 based on the corresponding timestamp) may also correspond to the first pause duration.

In an alternate embodiment, the speech processing unit 210 may be configured to perform the one or more mathematical operations such as, but not limited to cube root, logarithmic operations on the first pause duration to determine the second feature-25 of the first audio segment.

Second Feature-26 ($f_{26}^{first}$)

The speech processing unit 210 may determine a second feature (second feature-26) of the first audio segment. In an embodiment, the speech processing unit 210 may determine the second feature-26 of the first audio segment based on the first audio segment and a second audio segment, such that the second audio segment is temporally adjacent and prior to the first audio segment.

In an embodiment, the speech processing unit 210 may be configured to determine a second pause duration for the first audio segment based on the timestamp of the first audio segment and the timestamp of the second audio segment. In an embodiment, the second pause duration may correspond to a difference between an end time instant of the second audio segment and a start time instant of the first audio segment. The speech processing unit 210 may identify the start time instant of the first audio segment from the corresponding timestamp and the end time instant of the second audio segment from the corresponding timestamp. Further, the speech processing unit 210 may determine the difference between the end time instant of the second audio segment and the start time instant of the first audio segment, (i.e., the second pause duration). In an embodiment, the second silence duration determined by the speech processing unit 210 may correspond to the second feature-26 of the first audio segment.

For example, the speech processing unit 210 may determine the start time instant of a first audio segment, identified from the corresponding timestamp, such that the corresponding timestamp is 15:45:000 and the end time instant of a second audio segment, identified from the corresponding timestamp, such that the corresponding timestamp is 15:44:000. Thus, the speech processing unit 210 may identify the second pause duration as 1 second. Therefore, the speech processing unit 210 may identify the second feature-26 as 1 second, based on the second pause duration.

As discussed supra, the one or more audio segments comprise an uninterrupted audio corresponding to a user. In an embodiment, the one or more audio segments may comprise a speech conversation between two users, such that the first audio segment may correspond to the first user of the two users and the second audio segment may correspond to the second user of the two users. Further, before the first user starts speaking, after the second user has stopped speaking, there may exist a silence/noise. In an embodiment, the time duration corresponding to the silence/noise between the first audio segment and the second audio may also correspond to the second pause duration.

In an alternate embodiment, the speech processing unit 210 may be configured to perform the one or more mathematical operations such as, but not limited to cube root, and logarithmic operations on the second pause duration for determining the second feature-26 of the first audio segment.

A person having ordinary skill in the art will understand the aforementioned example is for illustrative purpose and should not be construed to limit the scope of the disclosure.

Second Feature-27 ($f_{27}^{first}$)

The speech processing unit 210 may determine a second feature (second feature-27) of the first audio segment. In an embodiment, the speech processing unit 210 may be configured to determine the second feature-27 of the first audio segment based on a count of one or more audio frames that are identified as the one or more speech frames as well as the one or more voiced frames. In an embodiment, the speech processing unit 210 may check the first binary value and the second binary value assigned to each of the one or more audio frames. In an embodiment, the speech processing unit 210 may identify the one or more audio frames with the second binary value "1" (i.e., the one or more speech frames). Further, the speech processing unit 210 may be configured to determine a count of the one or more speech frames with the first binary value "1" (i.e., the one or more speech frames that are also identified as the one or more voiced frames). In an embodiment, the speech processing unit 210 may be configured to determine a percentage of the count of the one or more speech frames with the first binary value "1". In an embodiment, the percentage of the count of the one or more speech frames with the first binary value "1", determined by the speech processing unit 210, may correspond to the second feature-27 of the first audio segment. The determination of the second feature-27 has been explained in reference to FIG. 6.

Figure 6:
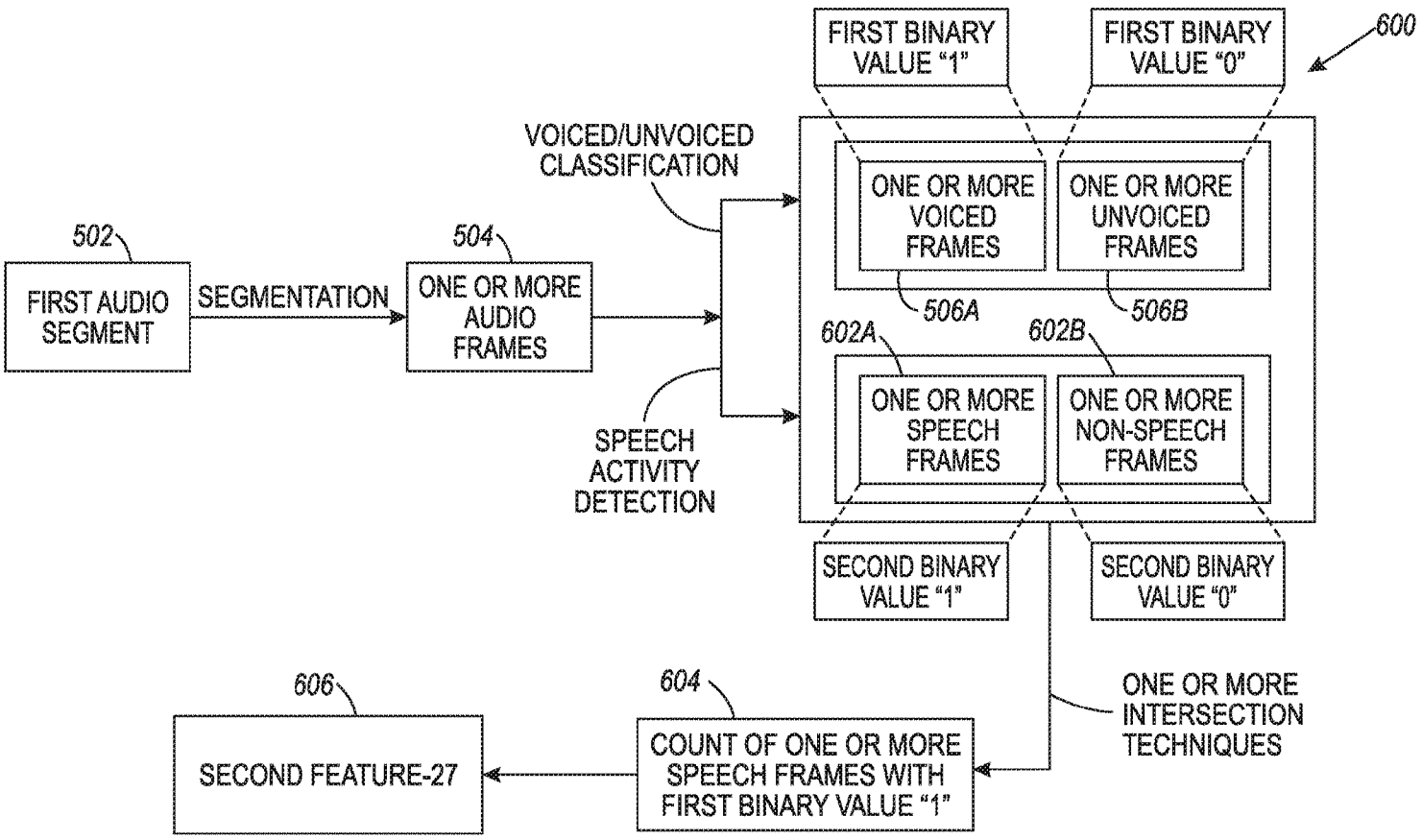
FIG. 6 illustrates an exemplary scenario to determine at least a second feature (i.e., second feature-27) of one or more second features of a first audio segment, in accordance with at least one embodiment.

FIG. 6 is a block diagram 600 of an exemplary scenario for determining second feature-27, in accordance with at least one embodiment.

Referring to FIG. 6, the first audio segment (depicted by 502) is segmented by the segmentation unit 208 to determine the one or more audio frames (depicted by 504). Thereafter, the one or more audio frames (depicted by 504) are processed by using the voiced/unvoiced classification technique to determine the one or more voiced frames (depicted by 506*a*) and the one or more unvoiced frames (depicted by 506*b*) from the one or more audio frames. Further, the one or more audio frames (depicted by 504) are processed by the speech activity detection technique to determine the one or more speech frames (depicted by 602*a*) and the one or more non-speech frames (depicted by 602*b*) from the one or more audio frames. In an embodiment, the speech processing unit 210 may assign the first binary value to the one or more audio frames (depicted by 504) based on the voiced/unvoiced classification technique, wherein the one or more audio frames with the first binary value as "1" may correspond to the one or more voiced frames (depicted by 506*a*) and the one or more audio frames with the first binary value as "0" may correspond to the one or more unvoiced frames (depicted by 506*b*). In an embodiment, the speech processing unit 210 may assign the second binary value to the one or more audio frames based on the speech activity detection technique, wherein the one or more audio frames with the second binary value as "1" may correspond to the one or more speech frames (depicted by 602*a*) and the one or more audio frames with the second binary value as "0" may correspond to the one or more non-speech frames (depicted by 602*b*). In an embodiment, the speech processing unit 210 may determine the count of the one or more audio frames with the first binary value as "1" and the second binary value as "1" (depicted by 604). Thereafter, based on the determined count of the one or more audio frames with the first binary value as "1" and the second binary value as "1" (depicted by 604), the speech processing unit 210 may determine the second feature-27 (depicted by 606). In an embodiment, the speech processing unit 210 may utilize one or more intersection techniques to determine the count of one or more audio frames that are identified as the one or more speech frames as well as the one or more voiced frames.

Referring to FIG. 3B, for example, Table 10 illustrates the one or more audio frames, the first binary values and the second binary values of the one or more audio frames.

TABLE 10

Illustration of the one or more audio frames, the first binary values and the second binary values of the one or more audio frames.

| One or more audio frames | First binary value | Second binary value |
|---|---|---|
| Frame 1 | 1 | 1 |
| Frame 2 | 0 | 1 |
| Frame 3 | 0 | 0 |
| Frame 4 | 0 | 0 |
| Frame 5 | 1 | 1 |
| Frame 6 | 0 | 1 |

Referring to Table 10, the speech processing unit 210 may determine that from 6 audio frames (Frame 1, Frame 2, Frame 3, Frame 4, Frame 5 and Frame 6), 4 audio frames are with second binary value as "1" (Frame 1, Frame 2, Frame 5 and Frame 6). Further, out of the four audio frames, two audio frames have the first binary value as "1" (i.e., Frame 1 and Frame 5). Thus, the speech processing unit 210 determines the percentage of the count of the one or more speech frames with the first binary value "1" as 50%. Thus, the second feature-27, as determined by the speech processing unit 210, is 50%. In an alternate embodiment, the speech processing unit 210 may perform the one or more mathematical operations on the determined percentage such as, but not limited to, cube root, and fifth root, for determining the second feature-27 of the first audio segment.

A person having ordinary skill in the art will appreciate that the scope of the disclosure is not limited to determining the second feature-27 based on the abovementioned example technique.

Second Feature-28 ($f_{28}^{first}$)

The speech processing unit 210 may determine a second feature (second feature-28) of the first audio segment. In an embodiment, the speech processing unit 210 may be configured to determine the second feature-28 of the first audio segment based on the intensity contour of the first audio segment. In an embodiment, the speech processing unit 210 may identify the one or more intensity values in the intensity contour corresponding to the one or more speech frames. Further, the speech processing unit 210 may be configured to determine a second predefined percentile for the one or more intensity values corresponding to the one or more speech frames. In an embodiment, the second predefined percentile, determined by the speech processing unit 210, may correspond to the second feature-28 of the first audio segment. In an embodiment, the speech processing unit 210 may be configured to normalize the one or more intensity values based on a mode of the intensity histogram i.e., (intensity floor). In an embodiment, the speech processing unit 210 may determine the second feature-28 by utilizing known in the art algorithms such as, but are not limited to, nearest rank algorithm, and linear interpolation between closest rank algorithm.

For example, the speech processing unit 210 may determine 98th percentile (n=98) of the one or more intensity values of the one or more speech frames, such that the 98th percentile corresponds to the second predefined percentile (i.e., the second feature-27 of the first audio segment). In an embodiment, the value of 'n' may be defined by a user. In an alternate embodiment, the value of 'n' may be determined by the speech processing unit 210 (based on some experiments).

In an exemplary scenario, the speech processing unit 210 may determine the one or more intensity values corresponding to the one or more speech frames in the intensity contour of the first audio segment, such as 70 dB, 72 dB, 73 dB, 72 dB, 69 dB, 75 dB, and 72 dB. The speech processing unit 210 identifies 72 dB as the mode of the one or more intensity values (i.e., the intensity floor) and may normalize the one or more intensity values as (0.972, 1, 1.01, 1, 0.958, 1.041, and 1). Further, the speech processing unit 210 may determine the second predefined percentile (e.g., 98th percentile) of the normalized one or more intensity values as the 6th value in 0.958, 0.972, 1, 1, 1, 1.01, and 1.041, i.e., 1.01. Thus, the speech processing unit 210 may determine the second feature-28 as 1.01. In an alternate embodiment, the speech processing unit 210 may configured to perform the one or more logarithmic operations on the second predefined percentile of the one or more intensity values to determine the second feature-28 of the first audio segment.

A person having ordinary skill in the art will appreciate that the scope of the disclosure is not limited to determining the second feature-28 based on the abovementioned example technique.

Second Feature-29 ($f_{29}^{first}$)

The speech processing unit 210 may determine a second feature (second feature-29) of the first audio segment. In an embodiment, the speech processing unit 210 may be configured to determine the second feature-29 of the first audio segment based on the intensity contour of the first audio segment. In an embodiment, the speech processing unit 210 may identify the one or more intensity values in the intensity contour corresponding to the one or more speech frames. Further, the speech processing unit 210 may be configured to determine a standard deviation of the one or more intensity values corresponding to the one or more speech frames. In an embodiment, the standard deviation of the one or more intensity values may correspond to the second feature-29 of the first audio segment. In another embodiment, the speech processing unit 210 may be configured to determine the standard deviation of the normalized one or more intensity values (normalized by the intensity floor).

In an exemplary scenario, the speech processing unit 210 may determine the one or more intensity values corresponding to the one or more speech frames in the intensity contour of the first audio segment, such as 70 dB, 72 dB, 73 dB, 72 dB, 69 dB, 75 dB, and 72 dB. The speech processing unit 210 identifies 72 dB as a mode of the one or more intensity values and may normalize the one or more intensity values as 0.972, 1, 1.01, 1, 0.958, 1.041, and 1. Further, the speech processing unit 210 may determine a standard deviation of the normalized one or more intensity values as 0.0246. Thus, the speech processing unit 210 determines second feature-29 as 0.0246. In an alternate embodiment, the speech processing unit 210 may perform the one or more logarithmic operations on the standard deviation of the one or more intensity values for determining the second feature-29 of the first audio segment.

A person having ordinary skill in the art will appreciate that the scope of the disclosure is not limited to determining the second feature-29 based on the abovementioned example technique.

Second Feature-30 ($f_{30}^{first}$)

The speech processing unit 210 may determine a second feature (second feature-30) of the first audio segment. In an embodiment, the speech processing unit 210 may be configured to determine the second feature-30 of the first audio segment based on the intensity contour of the first audio segment. To determine the second feature-30, the speech processing unit 210 may be configured to divide the intensity contour of the first audio segment into one or more second chunks of a predefined time duration. Further, the speech processing unit 210 may be configured to perform transformation technique on the one or more second chunks of the intensity contour to determine one or more third coefficients for each of the one or more second chunks. The speech processing unit 210 may use a known in the art transformation techniques such as, but not limited to, Discrete Cosine Transform (DCT), Fast Fourier Transform (FFT) to determine the one or more third coefficients for each of the one or more second chunks. Thereafter, the speech processing unit 210 may be configured to determine a second percentage energy in the one or more third coefficients of each of the one or more second chunks. In another embodiment, the speech processing unit 210 may be configured to determine the second percentage energy for a predefined count of the one or more third coefficients. The speech processing unit 210 may utilize one or more known in the art energy computation techniques such as, but not limited to, a short time energy computation technique.

In an embodiment, speech processing unit 210 may further determine a mean of the second percentage energy of each of the one or more second chunks, for determining the second feature-30 of the first audio segment. In an embodiment, the determined mean of the second percentage energy may correspond to the second feature-30 of the first audio segment. The determination of the second feature-30 has been explained with reference to FIG. 7.

Figure 7:
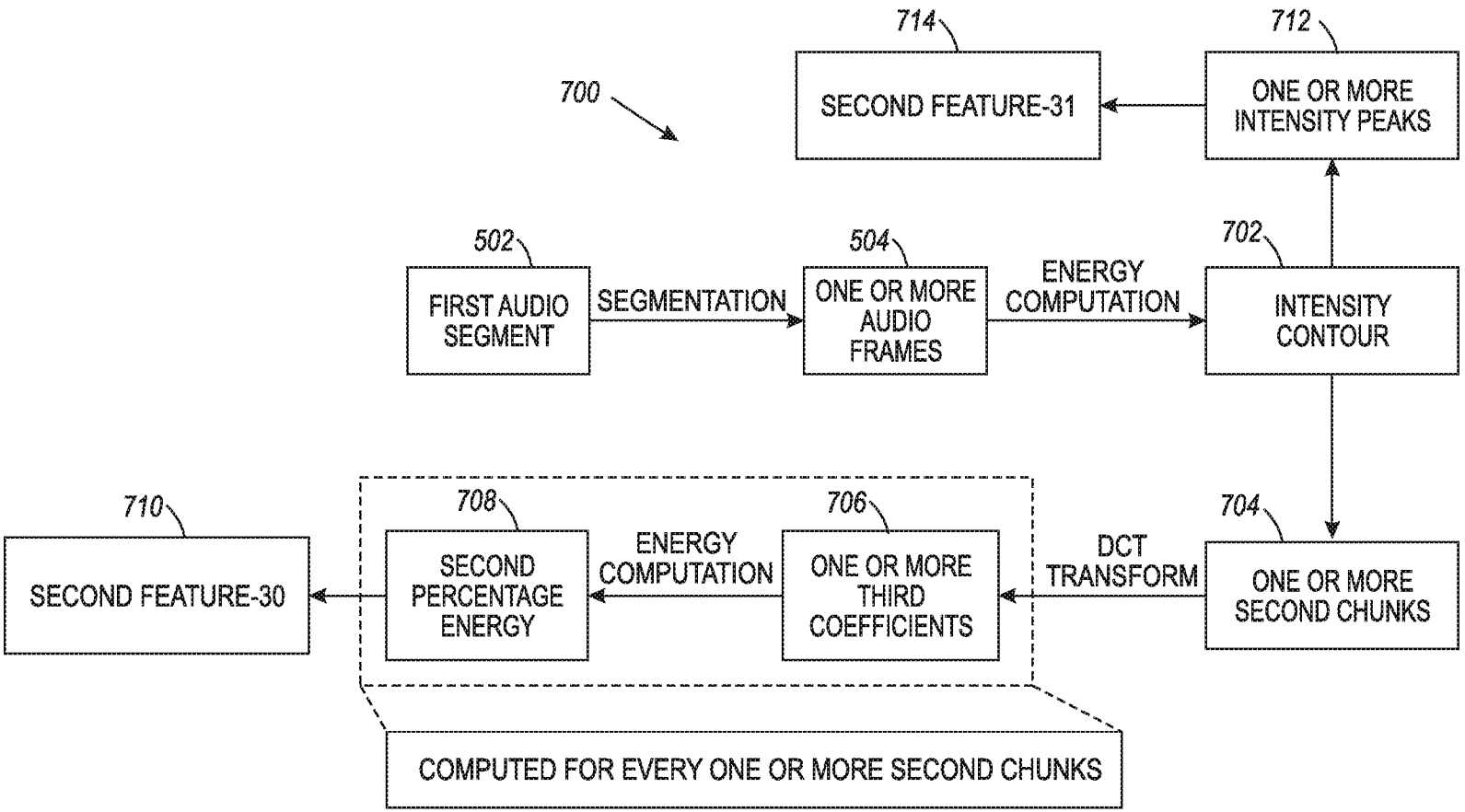
FIG. 7 illustrates an exemplary scenario to determine at least a second feature (i.e., second feature-30 and/or second feature-31) of one or more second features of a first audio segment, in accordance with at least one embodiment.

FIG. 7 is a block diagram 700 of an exemplary scenario for determining the second feature-30 and a second feature-31, in accordance with at least one embodiment.

Referring to FIG. 7, the first audio segment (depicted by 502) is segmented by the segmentation unit 208 to determine the one or more audio frames (depicted by 504). Thereafter, the one or more audio frames (depicted by 504) are processed by using a known in the art energy computation technique for determining the intensity contour of the first audio segment (depicted by 702). Further, the speech processing unit 210 may divide the intensity contour of the first audio segment in to the one or more second chunks (depicted by 704). In an embodiment, the speech processing unit 210 may be configured to utilize the one or more transformation techniques on each of the one or more second chunks (depicted by 704) to determine the one or more third coefficients for each the one or more second chunks (depicted by 706). Thereafter, the speech processing unit 210 may determine the second percentage energy in the one or more third coefficients of each of the one or more second chunks (depicted by 708). In an embodiment, the speech processing unit 210 may determine the mean of the second percentage energy (depicted by 710) associated with each of the one or more second chunks. In an embodiment, the determined mean (depicted by 710) may correspond to the second feature-30 of the first audio segment. In an alternate embodiment, the speech processing unit 210 may perform the one or more logarithmic operations on the third standard deviation of the one or more intensity values for determining the second feature-30 of the first audio segment.

Referring to FIG. 3B, a person having ordinary skill in the art will appreciate that the scope of the disclosure is not limited to determining the second feature-30 based on the abovementioned scenario.

Second Feature-31 ($f_{31}^{first}$)

The speech processing unit 210 may determine a second feature (second feature-31) of the first audio segment. In an embodiment, the speech processing unit 210 may be configured to determine the second feature-31 of the first audio segment based on the intensity contour of the first audio segment. In an embodiment, the speech processing unit 210 may be configured to determine a standard deviation of the one or more intensity peaks in the intensity contour of the first audio segment. Further, the determined standard deviation of the one or more intensity peaks in the intensity contour of the first audio segment may correspond to the second feature-31 of the first audio segment. In an embodiment, the speech processing unit 210 may determine the second feature-31 based on equation 5, shown below:

$$f_{31}^{first}=\log_{10}(IP_{std}+1) \quad (5)$$

where, $f_{31}^{first}$ represents the second feature-31 of the first audio segment; and $IP_{std}$ represents the standard deviation of the one or more intensity peaks.

A person having ordinary skill in the art will appreciate that the scope of the disclosure is not limited to determining the second feature-31 based on the abovementioned technique. In another embodiment, the speech processing unit 210 may identify one or more pairs of the one or more intensity peaks, such that the intensity peaks in each of the one or more pairs of the one or more intensity peaks are separated by a predefined time gap in the intensity contour. Further, the speech processing unit 210 may be configured to select one intensity peak from each pair of the one or more pairs, such that the selected intensity peak from the pair has higher intensity value compared with the other intensity peak in the pair. Thereafter, the speech processing unit 210 may determine the standard deviation of the selected one or more intensity peaks in the intensity contour of the first audio segment for determining the second feature-31 of the first audio segment. The determination of the second feature-31 has further been explained with reference to FIG. 7.

Referring FIG. 7, the first audio segment (depicted by 502) is segmented by the segmentation unit 208 to determine the one or more audio frames (depicted by 504). Thereafter, the one or more audio frames (depicted by 504) are processed by using a known in the art energy computation technique such as, but not limited to, a short time energy computation technique, for determining the intensity contour of the first audio segment (depicted by 702). Further, the speech processing unit 210 may determine the one or more intensity peaks in the intensity contour of the first audio segment (depicted by 712). Thereafter, the speech processing unit 210 may determine the standard deviation of the one or more intensity peaks (based on the equation 5), such that the standard deviation of the one or more intensity peaks corresponds to the second feature-31 (depicted by 714) of the first audio segment. In an alternate embodiment, the speech processing unit 210 may perform the one or more logarithmic operations on the standard deviation of the one or more intensity peaks to determine the second feature-31 of the first audio segment.

Referring to FIG. 3B, a person having ordinary skill in the art will appreciate that the scope of the disclosure is not limited to determining the second feature-31 based on the abovementioned technique.

Second Feature-32 ($f_{33}^{first}$)

The speech processing unit 210 may determine a second feature (second feature-32) of the first audio segment. In an embodiment, the speech processing unit 210 may be configured to determine the second feature-32 of the first audio segment based on the one or more first chunks, and the one or more filter bank outputs corresponding to each of the one or more first chunks. As discussed supra, the one or more first chunks of the spectrogram of the first audio segment are subjected to the one or more filter banks for determining the one or more filter bank outputs. In an embodiment, the speech processing unit 210 may be configured to determine a variance, of the one or more filter bank outputs, for each of the one or more first chunks. Further, the speech processing unit 210 may determine a third predefined percentile of the variance of each of the one or more first chunks. In an embodiment, the third predefined percentile of the variance, determined by the speech processing unit 210, may correspond to the second feature-32 of the first audio segment.

For example, the speech processing unit 210 may determine a 5th percentile of the first variance (n=5), such that the 5th percentile corresponds to the third predefined percentile (i.e., the second feature-32 of the first audio segment). In an embodiment, the value of 'n' may be defined by a user. In an alternate embodiment, the value of 'n' may be determined by the speech processing unit 210. In an alternate embodiment, the speech processing unit 210 may also be configured to perform the one or more logarithmic operations on the third predefined percentile to determine the second feature-32 of the first audio segment.

A person having ordinary skill in the art will appreciate that the scope of the disclosure is not limited to determining the second feature-32 based on the abovementioned technique.

Second Feature-33 ($f_{33}^{first}$)

The speech processing unit 210 may determine a second feature (second feature-33) of the first audio segment. In an embodiment, the speech processing unit 210 may be configured to determine the second feature-33 of the first audio segment based on the one or more first chunks, and the one or more filter bank outputs corresponding to each of the one or more first chunks. To determine the second feature-33, the speech processing unit 210 may be configured to identify the one or more first chunks that correspond to a first predefined time duration of the spectrogram of the first audio segment. In an embodiment, the first predefined time duration of the spectrogram of the first audio segment may be specified by a user. In an alternate embodiment, the speech processing unit 210 may be configured to determine the first predefined time duration of the spectrogram. Thereafter, the speech processing unit 210 may be configured to identify the one or more filter bank outputs corresponding to each of the identified one or more first chunks.

In an embodiment, the speech processing unit 210 may determine a variance, of the identified one or more filter bank outputs, for each of the identified one or more first chunks. Thereafter, the speech processing unit 210 may determine a fourth predefined percentile of the variance. In an embodiment, the fourth predefined percentile of the variance, as determined by the speech processing unit 210, may correspond to the second feature-33 of the first audio segment.

For example, the speech processing unit 210 may determine the first predefined time duration, such as temporally last 750 ms of the spectrogram of the first audio segment. The speech processing unit 210 may determine a 95th percentile of the second variance (n=95), such that the 95th percentile corresponds to the fourth predefined percentile. In an embodiment, the value of 'n' may be defined by a user. In an alternate embodiment, the value of 'n' may be determined by the speech processing unit 210. The speech processing unit 210 may identify the one or more first chunks corresponding to the temporally last 750 ms of the spectrogram of the first audio segment. Further, the speech processing unit 210 may identify the one or more filter bank outputs corresponding to the identified one or more first chunks. Thereafter, the speech processing unit 210 may determine the variance, of the identified one or more filter bank outputs. Further, the speech processing unit 210 may determine the 95th percentile of the variance. In accordance with ongoing example, the 95th percentile corresponds to the second feature-33 of the first audio segment. In an alternate embodiment, the speech processing unit 210 may also be configured to perform one or more logarithmic operations on the fourth predefined percentile to determine the second feature-1 of the first audio segment.

A person having ordinary skill in the art will understand that the abovementioned example of the first predefined time duration is for illustrative purposes and should not be construed to limit the scope of the disclosure.

Second Feature-34 ($f_{34}^{first}$)

The speech processing unit 210 may determine a second feature (second feature-34) of the first audio segment. In an embodiment, the speech processing unit 210 may be configured to determine the second feature-34 of the first audio segment based on the one or more first chunks and the one or more filter bank outputs of each of the one or more first chunks in the spectrogram of the first audio segment. In an embodiment, the speech processing unit 210 may be configured to determine a variance, of the one or more filter bank outputs, for each of the one or more first chunks. Further, the speech processing unit 210 may determine a fifth predefined percentile of the variance. In an embodiment, the fifth predefined percentile of the variance of the one or more first chunks, in the spectrogram of the first audio segment, as determined by the speech processing unit 210, may correspond to the second feature-34 of the first audio segment.

For example, the speech processing unit 210 may determine a 95th percentile of the second variance (n=95), such that the 95th percentile corresponds to the fifth predefined percentile. In an embodiment, the value of 'n' may be defined by a user. In an alternate embodiment, the value of 'n' may be determined by the speech processing unit 210. In an alternate embodiment, the speech processing unit 210 may also be configured to perform the one or more logarithmic operations on the fifth predefined percentile to determine the second feature-34 of the first audio segment.

A person having ordinary skill in the art will understand that the abovementioned example of the fifth predefined percentile is for illustrative purposes and should not be construed to limit the scope of the disclosure.

Second Feature-35 ($f_{35}^{first}$)

The speech processing unit 210 may determine a second feature (second feature-35) of the first audio segment. In an embodiment, the speech processing unit 210 may be configured to determine the second feature-35 of the first audio segment based on a predefined start duration of the first audio segment. In an embodiment, the speech processing unit 210 may be configured to determine a third chunk in the spectrogram of the first audio segment corresponding to the predefined start duration. Further, the speech processing unit 210 may determine one or more filter bank outputs corresponding to the third chunk by utilizing the one or more filter banks known in the art such as, but not limited to, MEL filter bank, and Linear prediction filter bank. Furthermore, the speech processing unit 210 may determine one or more fourth coefficients of the one or more filter bank outputs corresponding to the third chunk by utilizing one or more transformation techniques known in the art such as, but not limited to, Discrete Cosine Transform, and Fast Fourier Transform. For example, the speech processing unit 210 may identify the third chunk from the spectrogram of the first audio segment corresponding to a first "1 second" (i.e., the predefined start duration) of the first audio segment. In an embodiment, the predefined start duration may be defined by a user. In an alternate embodiment, the predefined start duration may be determined by the speech processing unit 210.

In an embodiment, after the determination of the one or more fourth coefficients, the speech processing unit 210 may determine a third percentage energy in the one or more fourth coefficients of each of the one or more filter bank outputs corresponding to the third chunk. Thereafter, the speech processing unit 210 may be configured to determine a mean of the third percentage energy associated with each of the one or more fourth coefficients of the each of the one or more filter bank outputs corresponding to the third chunk. In an embodiment, the determined mean of the third percentage energy may correspond to the second feature-35 of the first audio segment.

In an alternate embodiment, the speech processing unit 210 may be configured to determine the third percentage energy for a predetermined count of the one or more fourth coefficients of each of the one or more filter bank outputs corresponding to the third chunk. For example, the speech processing unit 210 may determine the one or more fourth coefficients corresponding to a filter bank output of the third chunk, such as $C_1$, $C_2$, $C_3$, $C_4$, $C_5$, $C_6$, $C_7$, $C_8$, $C_9$, $C_{10}$, and $C_{11}$. The speech processing unit 210 may determine the third percentage energy contained in the $C_2$, $C_3$, $C_4$, $C_5$, $C_6$, $C_7$, $C_8$, $C_9$, and $C_{10}$ coefficients of the filter bank output. The speech processing unit 210 may determine the third percentage energy in each of the one or more filter bank outputs of the third chunk, such as 75.9%, 87%, 63%, 76%, 85%, and 79%. Thus, the mean of the third percentage energy of the one or more filter bank outputs of the third chunk, as determined by the speech processing unit 210, is 77.65%. Therefore, in accordance with the ongoing example, 77.65% may correspond to the second feature-35 of the first audio segment. The determination of the second feature-35 has been explained with reference to FIG. 8.

Figure 8:
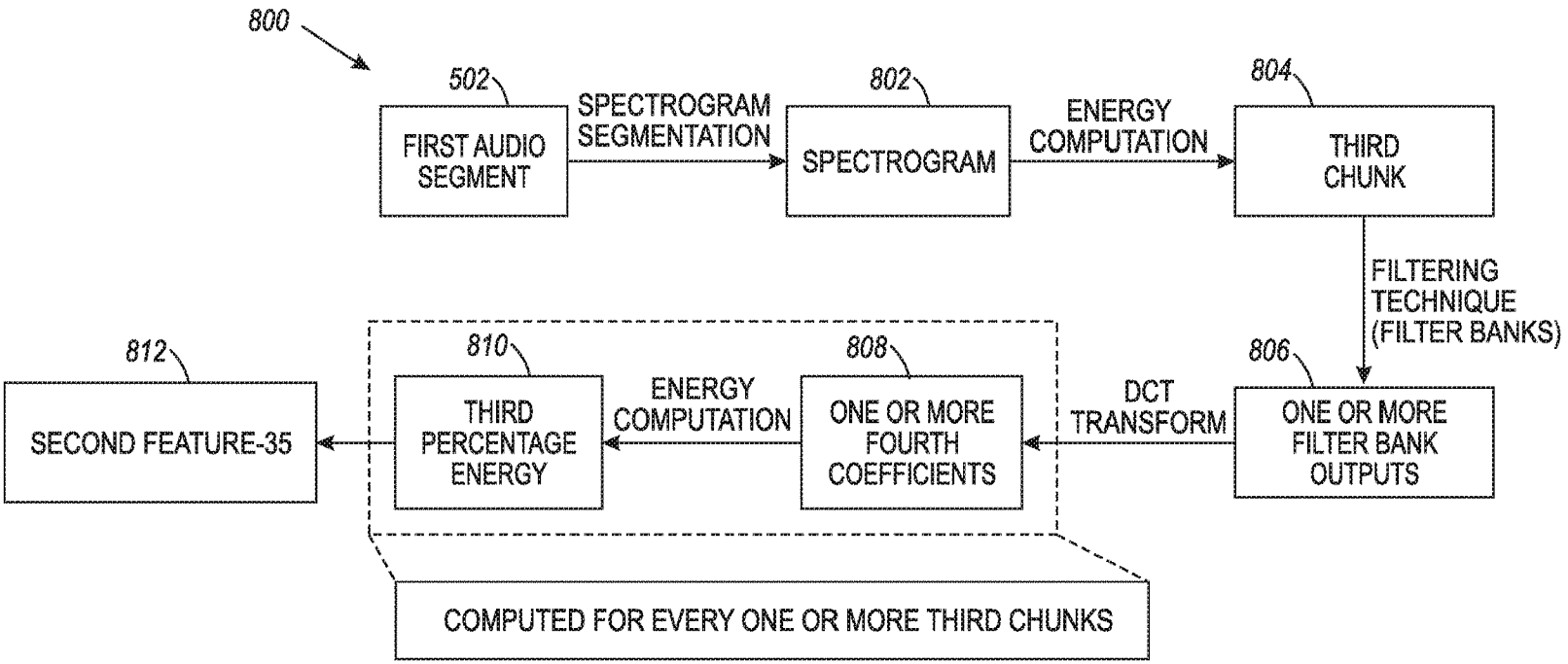
FIG. 8 illustrates an exemplary scenario to determine at least a second feature (i.e., second feature-35) of one or more second features of a first audio segment, in accordance with at least one embodiment.

FIG. 8 is a block diagram 800 of an exemplary scenario for determining second feature-35, in accordance with at least one embodiment.

Referring to FIG. 8, the spectrogram (depicted by 802) is computed from the first audio segment (depicted by 502) based on the one or more spectrogram computation techniques known in the art. Further, the third chunk (depicted by 804) is determined from the spectrogram (depicted by 802) based on the predefined start duration of the first audio segment. Thereafter, the speech processing unit 210 may determine the one or more filter bank outputs (depicted by 806) for the third chunk based on the one or more filter banks known in the art. In an embodiment, the speech processing unit 210 may be configured to perform the one or more transformation techniques on each of the one or more filter bank outputs (depicted by 806) to determine the one or more fourth coefficients (depicted by 808) for each the one or more filter bank outputs (depicted by 806). Thereafter, the speech processing unit 210 may determine the third percentage energy (depicted by 810) in the one or more fourth coefficients of each of the one or more filter bank outputs of the third chunk. Further, the speech processing unit 210 may determine the mean of the third percentage energy (depicted by 812) of the one or more fourth coefficients of each of the one or more filter bank outputs of the third chunk. In an embodiment, the mean of the third percentage energy (depicted by 812) may correspond to the second feature-35 of the first audio segment.

In an alternate embodiment, the speech processing unit 210 may perform the one or more logarithmic operations on the mean of the third percentage energy to determine the second feature-35 of the first audio segment.

Referring to FIG. 3B, a person having ordinary skill in the art will understand that the above mentioned example is for illustrative purpose and should not be construed to limit the scope of the disclosure.

Second Feature-36 ($f_{36}^{first}$)

The speech processing unit 210 may determine a second feature (second feature-36) of the first audio segment. In an embodiment, the speech processing unit 210 may be configured to determine the second feature-36 of the first audio segment based on a predefined end duration of the first audio segment. In an embodiment, the speech processing unit 210 may be configured to determine a fourth chunk in the spectrogram of the first audio segment corresponding to the predefined end duration. Further, the speech processing unit 210 may determine one or more filter bank outputs corresponding to the fourth chunk by utilizing the one or more filter banks known in the art such as, but not limited to, MEL filter bank, and Linear prediction filter bank. Furthermore, the speech processing unit 210 may determine one or more fifth coefficients of the one or more filter bank outputs corresponding to the fourth chunk by utilizing one or more transformation techniques known in the art such as, but not limited to, Discrete Cosine Transform, and Fast Fourier Transform. For example, the speech processing unit 210 may identify the fourth chunk from the spectrogram of the first audio segment corresponding to a last "1 second" (i.e., the predefined end duration) of the first audio segment. In an embodiment, the predefined end duration may be defined by a user. In an alternate embodiment, the predefined end duration may be determined by the speech processing unit 210.

In an embodiment, after the determination of the one or more fifth coefficients, the speech processing unit 210 may determine a fourth percentage energy in the one or more fifth coefficients of each of the one or more filter bank outputs corresponding to the fourth chunk. Thereafter, the speech processing unit 210 may be configured to determine a mean of the fourth percentage energy of each of the one or more filter bank outputs corresponding to the fourth chunk. In an embodiment, the determined mean of the fourth percentage energy may correspond to the second feature-36 of the first audio segment.

In an alternate embodiment, the speech processing unit 210 may be configured to determine the fourth percentage energy for a predetermined count of the one or more fifth coefficients of each of the one or more filter bank outputs corresponding to the fourth chunk. For example, the speech processing unit 210 may determine the one or more fifth coefficients corresponding to a filter bank output of the fourth chunk, such as $C_1$, $C_2$, $C_3$, $C_4$, $C_5$, $C_6$, $C_7$, $C_8$, $C_9$, $C_{10}$, and $C_{11}$. The speech processing unit 210 may determine the fourth percentage energy contained in the $C_2$, $C_3$, $C_4$, $C_5$, $C_6$, $C_7$, $C_8$, $C_9$, and $C_{10}$ coefficients of the filter bank output. The speech processing unit 210 may determine the fourth percentage energy in each of the one or more filter bank outputs of the fourth chunk, such as 75.9%, 87%, 63%, 76%, 85%, and 79%. Thus, the mean of the fourth percentage energy in the one or more filter bank outputs of the fourth chunk, as determined by the speech processing unit 210, is 77.65%. In accordance with the ongoing example, 77.65% may correspond to the second feature-36 of the first audio segment. In an alternate embodiment, the speech processing unit 210 may perform the one or more logarithmic operations on the mean of the fourth percentage energy to determine the second feature-36 of the first audio segment.

A person having ordinary skill in the art will understand that the above mentioned example is for illustrative purpose and should not be construed to limit the scope of the disclosure.

Second Feature-37 ($f_{37}^{first}$)

The speech processing unit 210 may determine a second feature (second feature-37) of the first audio segment. In an embodiment, the speech processing unit 210 may be configured to determine the second feature-37 of the first audio segment based on one or more fifth chunks. In an embodiment, the speech processing unit 210 may be configured to determine the one or more fifth chunks from the spectrogram of the first audio segment, such that each of the one or more fifth chunks is of a predefined time duration. In an embodiment, the predefined time duration may be specified by a user. In an alternate embodiment, the predefined time duration may be determined by the speech processing unit 210. For example, the predefined time duration such as "1 second" may be determined by the speech processing unit 210. In this scenario, the speech processing unit 210 may determine the one or more fifth chunks of "1 second", from the spectrogram of the first audio segment.

A person having ordinary skill in the art will understand that above example for the predefined time duration is for illustrative purposes and should not be construed to limit the scope of the disclosure.

Further, the speech processing unit 210 may utilize the one or more filter banks known in the art such as, but not limited to, MEL filter bank, and Linear prediction filter bank, on one fifth chunk of the one or more fifth chunks, to determine one or more filter bank outputs for the one fifth chunk. A person having ordinary skill in the art will understand that for brevity, the one or more filter bank outputs are determined for the one fifth chunk. However, the one or more filter bank outputs may be determined for the remaining one or more fifth chunks also.

Furthermore, the speech processing unit 210 may determine one or more sixth coefficients for each of the one or more filter bank outputs of the one fifth chunk by utilizing one or more transformation techniques known in the art such as, but not limited to, Discrete Cosine Transform, and Fast Fourier Transform. In an embodiment, after determining the one or more sixth coefficients, the speech processing unit 210 may determine a fifth percentage energy of each of the one or more sixth coefficients of each of the one or more filter bank outputs of the one fifth chunk. In another embodiment, the speech processing unit 210 may be configured to determine the fifth percentage energy for a predetermined count of the one or more sixth coefficients of each of the one or more filter bank outputs the one fifth chunk. The speech processing unit 210 may utilize the one or more energy computation techniques known in the art for determining the fifth percentage energy, such as, but not limited to, a short time energy computation technique. For example, the speech processing unit 210 may be configured to determine the fifth percentage energy for $C_2$, $C_3$, $C_4$, $C_5$, $C_6$, $C_7$, $C_8$, $C_9$, and $C_{10}$ from $C_1$, $C_2$, $C_3$, $C_4$, $C_5$, $C_6$, $C_7$, $C_8$, $C_9$, $C_{10}$, and $C_{11}$ coefficients of a filter bank output of the one fifth chunk.

In an embodiment, the speech processing unit 210 may be configured to determine a mean of the fifth percentage energy associated with each of the one or more sixth coefficients of each of the one or more filter bank outputs of the one fifth chunk for the one fifth chunk. Similarly, the mean of the fifth percentage energy is determined by the speech processing unit 210 for each of the remaining one or more fifth chunks. Further, the speech processing unit 210 may be configured to determine a minimum mean from the mean of the fifth percentage energy associated with each of the one or more fifth chunks. In an embodiment, the minimum mean may correspond to the second feature-37 of the first audio segment.

For example, the mean of the fifth percentage energy of each of the one or more fifth chunks, such as 75.9%, 87%, 63%, 76%, 85%, and 79% may be determined by the speech processing unit 210. Thus, the minimum mean of the fifth percentage energy determined by the speech processing unit 210 is 63%. Therefore, 63% may correspond to the second feature-37 of the first audio segment. In an alternate embodiment, the speech processing unit 210 may perform the one or more logarithmic operations on the mean of the fifth percentage energy to determine the second feature-37 of the first audio segment.

A person having ordinary skill in the art will understand that the above mentioned example is for illustrative purpose and should not be construed to limit the scope of the disclosure.

Second Feature-38 ($f_{38}^{first}$)

The speech processing unit 210 may determine a second feature (second feature-38) of the first audio segment. In an embodiment, the speech processing unit 210 may be configured to determine the second feature-38 of the first audio segment based on the one or more fifth chunks of the predefined duration of the first audio segment and the mean of the fifth percentage energy associated with each of the one or more fifth chunks. In an embodiment, the speech processing unit 210 may be configured to determine a mean of the mean of the fifth percentage energy associated with each of the one or more fifth chunks. In an embodiment, the determined mean may correspond to the second feature-38 of the first audio segment.

For example, the speech processing unit 210 may determine the mean of the fifth percentage energy of each of the one or more fifth chunks, such as 75.9%, 87%, 63%, 76%, 85%, 79%. Thus, a mean of the mean of the fifth percentage energy associated with each of the one or more fifth chunks, determined by the speech processing unit 210, is 63%. In accordance with the ongoing example. 63% may correspond to the second feature-38 of the first audio segment. In an alternate embodiment, the speech processing unit 210 perform the one or more logarithmic operations on the second mean to determine the second feature-38 of the first audio segment.

A person having ordinary skill in the art will understand that the above mentioned example is for illustrative purpose and should not be construed to limit the scope of the disclosure.

Second Feature-39 ($f_{39}^{first}$)

The speech processing unit 210 may determine a second feature (second feature-39) of the first audio segment. In an embodiment, the speech processing unit 210 may determine the second feature-39 based on the frequency contour of the first audio segment. To determine the second feature-39, the speech processing unit 210 may be configured to determine the one or more first harmonic frequencies from the one or more harmonic frequencies in the frequency contour of the first audio segment. As discussed supra, the one or more first harmonic frequencies are associated with the one or more voiced frames and the one or more unvoiced frames of the first audio segment. Further, the speech processing unit 210 may be configured to determine a median frequency value of the one or more first harmonic frequencies and a maximum frequency value among the one or more first harmonic frequencies from the frequency contour of the first audio segment. In an embodiment, the speech processing unit 210 may normalize the maximum frequency value by utilizing the median frequency value. In an embodiment, the normalized maximum frequency value may correspond to the second feature-39 of the first audio segment.

For example, the speech processing unit 210 may determine the median frequency value, such as 730 Hz and a maximum frequency value, such as 770 Hz. The speech processing unit 210 may determine the normalized maximum value as 1.054. In this scenario, the second feature-39 may correspond to 1.054, as determined by the speech processing unit 210. In an alternate embodiment, the speech processing unit 210 may be configured to perform the one or more logarithmic operations on the normalized maximum value for determining the second feature-39 of the first audio segment.

A person having ordinary skill in the art will understand that the above example is for illustrative purposes and should not be construed to limit the scope of the disclosure.

Second Feature-40 ($f_{40}^{first}$)

The speech processing unit 210 may determine a second feature (second feature-40) of the first audio segment. In an embodiment, the speech processing unit 210 may be configured to determine the second feature-40 of the first audio segment based on the frequency contour of the first audio segment. To determine the second feature-40, the speech processing unit 210 may be configured to determine one or more sixth chunks of a predefined duration from the frequency contour of the first audio segment. Further, the speech processing unit 210 may determine a standard deviation of one or more first harmonic frequencies (determined from the one or more frequencies) in each of the one or more sixth chunks. Thereafter, the speech processing unit 210 may be configured to identify a minimum standard deviation among the standard deviation of the one or more first harmonic frequencies of each of the one or more sixth chunks. In an embodiment, the minimum standard deviation may correspond to the second feature-40 of the first audio segment. In an alternate embodiment, the speech processing unit 210 may be configured to perform the one or more logarithmic operations on the minimum standard deviation for determining the second feature-40 of the first audio segment.

A person having ordinary skill in the art will understand that the above technique for determining the second feature-40 is for illustrative purposes and should not be construed to limit the scope of the disclosure.

Second Feature-41 ($f_{41}^{first}$)

The speech processing unit 210 may determine a second feature (second feature-41) of the first audio segment. In an embodiment, the speech processing unit 210 may determine the second feature-41 based on the frequency contour of the first audio segment. To determine the second feature-41, the speech processing unit 210 may determine the one or more first harmonic frequencies from the one or more harmonic frequencies in the frequency contour of the first audio segment. Further, the speech processing unit 210 may be configured to determine a minimum frequency value among the one or more first harmonic frequencies from the frequency contour of the first audio segment. In an embodiment, the speech processing unit 210 may normalize the minimum frequency value by utilizing the median frequency value of the one or more first harmonic frequencies, as determined supra. In an embodiment, the normalized minimum frequency value may correspond to the second feature-41 of the first audio segment.

For example, the speech processing unit 210 may determine a minimum frequency value among the one or more harmonic frequencies of the first audio segment, such as 700 Hz and a median frequency value of the one or more first harmonic frequencies, such as 730 Hz. The speech processing unit 210 may determine the normalized minimum frequency value as 0.9589. In this scenario, the second feature-41 may correspond to 0.9589, as determined by the speech processing unit 210. In an alternate embodiment, the speech processing unit 210 may be configured to perform the one or more logarithmic operations on the normalized minimum frequency value among the one or more first harmonic frequencies for determining the second feature of the first audio segment.

A person having ordinary skill in the art will understand that the above example is for illustrative purposes and should not be construed to limit the scope of the disclosure.

Second Feature-42 ($f_{42}^{first}$)

The speech processing unit 210 may determine a second feature (second feature-42) of the first audio segment. In an embodiment, the speech processing unit 210 may be configured to determine the second feature-42 of the first audio segment based on the maximum frequency value among the one or more first harmonic frequencies from the frequency contour of the first audio segment and the minimum frequency value among the one or more first harmonic frequencies from the frequency contour of the first audio segment. In an embodiment, the speech processing unit 210 may determine a difference between the maximum frequency value and the minimum frequency value. In an embodiment, the difference, as determined by the speech processing unit 210, may correspond to the second feature-42 of the first audio segment.

In an alternate embodiment, the speech processing unit 210 may determine the difference between the normalized maximum frequency value and the normalized minimum frequency value to determine the second feature-42 of the first audio segment.

For example, the speech processing unit 210 may determine the normalized minimum frequency value, such as 0.9589 and the normalized maximum frequency value such as 1.054. In this scenario, the speech processing unit 210 may determine the difference between the normalized maximum frequency value and the normalized minimum frequency value as 0.0951. Thus, 0.0951 may correspond to the second feature-42 of the first audio segment. In an alternate embodiment, the speech processing unit 210 may be configured to perform the one or more logarithmic operations on the difference between the normalized maximum frequency value and the normalized minimum frequency value for determining the second feature-42 of the first audio segment.

A person having ordinary skill in the art will understand that the above example is for illustrative purposes and should not be construed to limit the scope of the disclosure.

At step 322, the one or more third features of the first audio segment are determined. In an embodiment, the speech processing unit 210 in conjunction with the processor may be configured to determine the one or more third features. In an embodiment, the speech processing unit 210 may determine a third feature based on a second feature of the one or more second features (as discussed supra) of the first audio segment, and a corresponding second feature of a second audio segment, such that the second audio segment may be temporally adjacent to the first audio segment. In an embodiment, the second audio segment may be temporally prior to the first audio segment. In another embodiment, the second audio segment may be temporally subsequent to the first audio segment. The speech processing unit 210 may determine each third feature (Third feature$^{first}$) of the one or more third features of the first audio segment using equation 6, shown below:

$$\text{Third feature}^{first} = \log_{10}\frac{f^{first}}{f^{second}} \tag{6}$$

where, $f^{first}$ is the second feature of the first audio segment; and $f^{second}$ is the corresponding second feature of the second audio segment.

In an embodiment, $f^{first}$ and $f^{second}$ may correspond to at least one of second feature-2, second feature-7, second feature-8, second feature-9, second feature-28, second feature-31, second feature-33, or second feature-34.

For example, the speech processing unit 210 may determine a third feature of the first audio segment by utilizing second feature-8, such that the third feature is represented by equation 7 shown below:

$$\text{Third feature}^{first} = \log_{10}\frac{f_8^{first}}{f_8^{second}} \tag{7}$$

A person having ordinary skill in the art will understand that the scope of disclosure is not limited to determining a third feature in the one or more third features based on at least one of second feature-2, second feature-7, second feature-8, second feature-9, second feature-28, second feature-31, second feature-33, or second feature-34. In an alternate embodiment, the speech processing unit 210 may determine the third feature in the one or more third features based on any second feature of the one or more second features (as discussed in step 320) of the first audio segment and the corresponding second feature of the second audio segment.

At step 324, the first audio segment is classified in either the interrogative category or the non-interrogative category based on one or more of the one or more second features and the one or more third features. In an embodiment, the classification unit 212 in conjunction with the processor 202 may classify the first audio segment in either the interrogative category or the non-interrogative category. The classification may be based on one or more of the one or more second features and the one or more third features. In an embodiment, the classification unit 212 may be configured to utilize the one or more classifiers to classify the first audio segment in either the interrogative category or the non-interrogative category. As discusses supra, the one or more classifiers are trained based on the training data. In an embodiment, the one or more trained classifiers may be utilized to classify the first audio segment in either the interrogative category or the non-interrogative category based on one or more of the one or more second features and the one or more third features. In an embodiment, the classification unit 212 may assign a third binary value to the first audio segment based on the classification by the one or more trained classifiers. In an embodiment, the third binary value "1" may correspond to the interrogative category and the third binary value "0" may correspond to the non-interrogative category.

A person having ordinary skill in the art will understand that in an alternate embodiment the third binary value "0" may correspond to the interrogative category and the third binary value "1" may correspond to the non-interrogative category.

Figure 4:
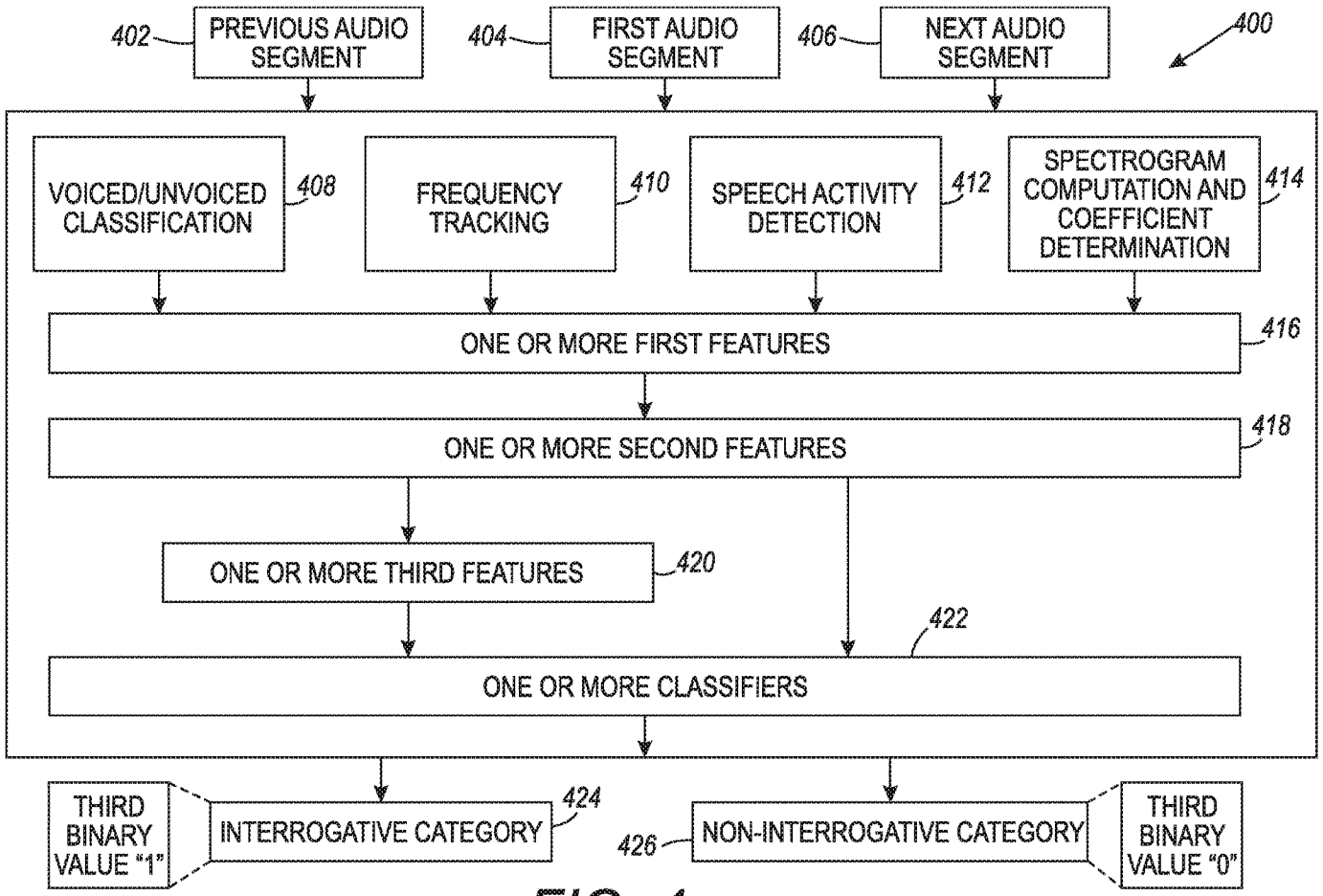
FIG. 4 is a block diagram that illustrates a method for classifying one or more audio segments of an audio signal, in accordance with at least one embodiment.

FIG. 4 is a block diagram 400 illustrating an exemplary scenario to classify the one or more audio segments in either the interrogative category or the non-interrogative category, in accordance with at least one embodiment. FIG. 4 has been explained in conjunction with FIG. 1, FIG. 2, FIG. 3A, and FIG. 3B.

With reference to FIG. 4, a previous audio segment (depicted by 402), a first audio segment (denoted by 404), and a next audio segment (depicted by 406) may be retrieved from the database server 104. The previous audio segment (depicted by 402) may correspond to the temporally prior and adjacent audio segment to the first audio segment (depicted by 404). The next audio segment (depicted by 406) may correspond to the temporally subsequent and adjacent audio segment to the first audio segment (depicted by 404). Further, the speech processing unit 210 may utilize the one or more speech processing techniques (depicted by 408, 410, 412, and 414) to determine the one or more first features (depicted by 416) corresponding to the first audio segment (depicted by 404). Furthermore, the speech processing unit 210 may utilize the one or more first features of the first audio segment to determine the one or more second features (depicted by 418) of the first audio segment (depicted by 404). Further, the speech processing unit 210 may determine a third feature of the one or more third features (depicted by 420) of the first audio segment based on a second feature from the one or more second features (depicted by 418) of the first audio segment and a corresponding second feature of the second audio segment. In an embodiment, the second audio segment may correspond to the previous audio segment (depicted by 402). In another embodiment, the second audio segment may correspond to the next audio segment (depicted by 406). Thereafter, the one or more trained classifiers (depicted by 422) may classify the first audio segment in either the interrogative category (depicted by 424) or the non-interrogative category (depicted by 426) based on the one or more second features (depicted by 418) and/or the one or more third features (depicted by 420). In an embodiment, the classification unit 212 may assign the third binary value to the first audio segment (depicted by 404) based on the classification by the one or more trained classifiers.

Various embodiments of the disclosure encompass numerous advantages. The disclosed methods and systems may classify one or more audio segments of an audio signal. The disclosed methods automatically classify the one or more audio segments of an audio signal into either an interrogative category or a non-interrogative category based on one or more second features and one or more third features determined from the one or more audio segments. In an embodiment, the methods and systems disclosed herein may be utilized to analyze a dialogue act between two or more entities involved in a conversation (e.g., a dialogue act between a customer care representative in a call center and a customer). Also, the disclosed methods and systems utilize the sequential information by determining the one or more third features from the one or more second features of two temporally adjacent audio segments of the audio signal for classifying the one or more audio segments. Further, the use of sequential information improves the accuracy of classifying the one or more audio segments. Furthermore, the disclosed methods and systems provide a robust, faster and reliable means for classifying the one or more audio segments of the audio signal.

The disclosed methods and systems, as illustrated in the ongoing description or any of its components, may be embodied in the form of a computer system. Typical examples of a computer system include a general-purpose computer, a programmed microprocessor, a micro-controller, a peripheral integrated circuit element, and other devices, or arrangements of devices that are capable of implementing the steps that constitute the method of the disclosure.

The computer system comprises a computer, an input device, a display unit and the Internet. The computer further comprises a microprocessor. The microprocessor is connected to a communication bus. The computer also includes a memory. The memory may be Random Access Memory (RAM) or Read Only Memory (ROM). The computer system further comprises a storage device, which may be a hard-disk drive or a removable storage drive, such as, a floppy-disk drive, optical-disk drive, and the like. The storage device may also be a means for loading computer programs or other instructions into the computer system. The computer system also includes a communication unit. The communication unit allows the computer to connect to other databases and the Internet through an input/output (I/O) interface, allowing the transfer as well as reception of data from other sources. The communication unit may include a modem, an Ethernet card, or other similar devices, which enable the computer system to connect to databases and networks, such as, LAN, MAN, WAN, and the Internet. The computer system facilitates input from a user through input devices accessible to the system through an I/O interface.

In order to process input data, the computer system executes a set of instructions that are stored in one or more storage elements. The storage elements may also hold data or other information, as desired. The storage element may be in the form of an information source or a physical memory element present in the processing machine.

The programmable or computer-readable instructions may include various commands that instruct the processing machine to perform specific tasks, such as steps that constitute the method of the disclosure. The systems and methods described can also be implemented using only software programming or using only hardware or by a varying combination of the two techniques. The disclosure is independent of the programming language and the operating system used in the computers. The instructions for the disclosure can be written in all programming languages including, but not limited to, 'C', 'C++', 'Visual C++' and 'Visual Basic'. Further, the software may be in the form of a collection of separate programs, a program module containing a larger program or a portion of a program module, as discussed in the ongoing description. The software may also include modular programming in the form of object-oriented programming. The processing of input data by the processing machine may be in response to user commands, the results of previous processing, or from a request made by another processing machine. The disclosure can also be implemented in various operating systems and platforms including, but not limited to, 'Unix', 'DOS', 'Android', 'Symbian', and 'Linux'.

The programmable instructions can be stored and transmitted on a computer-readable medium. The disclosure can also be embodied in a computer program product comprising a computer-readable medium, or with any product capable of implementing the above methods and systems, or the numerous possible variations thereof.

Various embodiments of the methods and systems for classifying an audio signal have been disclosed. However, it should be apparent to those skilled in the art that modifications in addition to those described, are possible without departing from the inventive concepts herein. The embodiments, therefore, are not restrictive, except in the spirit of the disclosure. Moreover, in interpreting the disclosure, all terms should be understood in the broadest possible manner consistent with the context. In particular, the terms "comprises" and "comprising" should be interpreted as referring to elements, components, or steps, in a non-exclusive manner, indicating that the referenced elements, components, or steps may be present, or utilized, or combined with other elements, components, or steps that are not expressly referenced.

A person having ordinary skills in the art will appreciate that the system, modules, and sub-modules have been illustrated and explained to serve as examples and should not be considered limiting in any manner. It will be further appreciated that the variants of the above disclosed system elements, or modules and other features and functions, or alternatives thereof, may be combined to create other different systems or applications.

Those skilled in the art will appreciate that any of the aforementioned steps and/or system modules may be suitably replaced, reordered, or removed, and additional steps and/or system modules may be inserted, depending on the needs of a particular application. In addition, the systems of the aforementioned embodiments may be implemented using a wide variety of suitable processes and system modules and is not limited to any particular computer hardware, software, middleware, firmware, microcode, or the like.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. A method for speech recognition, the method comprising:

recording, by a user-computing device comprising a microphone and a display unit, an audio signal of a voiced conversation;

storing, by a database server comprising a memory, the audio signal received through a communication medium from the user-computing device;

receiving from the database server through the communication medium, by an application server comprising a transceiver configured for wired or wireless communication through the communication medium, the audio signal of the voiced conversation, the application server further comprising a segmentation unit and one or more processors;

sampling, by a segmentation unit, the audio signal to generate a plurality of audio segments of the voiced conversation;

computing, by one or more processors, a first spectrogram of a first audio segment of the audio segments based on one or more speech processing techniques, wherein the first audio segment comprises an uninterrupted audio of a user;

dividing, by the one or more processors, the first spectrogram of the first audio segment into a plurality of first chunks each having a first predetermined time duration;

applying, by the one or more processors, a first array of band-pass filters to the first chunks to determine first filter outputs;

determining, by the one or more processors, a first variance of the first filter outputs for each of the first chunks of the first spectrogram;

determining, by the one or more processors, a first predetermined percentile of the first variance of the first filter outputs;

identifying, by the one or more processors, a second audio segment from the audio segments of the voice conversation, the second audio segment being temporally adjacent the first audio segment;

computing, by the one or more processors, a second spectrogram of the second audio segment;

dividing, by the one or more processors, the second spectrogram of the second audio segment into a plurality of second chunks each having a second predetermined time duration;

applying, by the one or more processors, a second array of band-pass filters to the second chunks to determine second filter outputs;

determining, by the one or more processors, a second variance of the second filter outputs for each of the second chunks of the second spectrogram;

determining, by the one or more processors, a second predetermined percentile of the second variance of the second filter outputs;

determining, by the one or more processors, a ratio between the first predetermined percentile of the first variance and the second predetermined percentile of the second variance;

classifying, by the one or more processors, the first audio segment either in an interrogative category that corresponds to a question statement or a non-interrogative category that does not correspond to a question statement, based on the ratio between the first predetermined percentile of the first variance associated with the first audio segment and the second predetermined percentile of the second variance associated with the second audio segment;

transmitting, by the transceiver, the classification of the first audio segment to the user-computing device through the communication medium; and displaying the classification on the display unit.

2. The method according to claim 1, further comprising identifying one or more voiced frames and one or more unvoiced frames from each of the audio segments based on at least a voiced/unvoiced classification technique.

3. The method according to claim 2, further comprising determining a percentage of the one or more voiced frames in the first audio segment.

4. The method according to claim 2, further comprising determining a first percentage of voiced frames in the one or more voiced frames, of the first audio segment, with a first cross-correlation greater than or equal to a first predefined value.

5. The method according to claim 4, further comprising determining, by the one or more processors, one or more continuous voiced frames, associated with the first audio segment, based on the one or voiced frames of the first audio segment, wherein each of the one or more continuous voiced frames comprises the one or more voiced frames that are temporally adjacent to each other.

6. The method according to claim 5, further comprising determining a time duration of a temporally last continuous voiced frame in the one or more continuous voiced frames.

7. The method according to claim 5, further comprising determining an average time duration of the one or more continuous voiced frames.

8. The method according to claim 5, further comprising determining a count of the one or more continuous voiced frames.

9. The method according to claim 5, further comprising determining a count of the one or more continuous voiced frames per unit time in the first audio segment.

10. The method according to claim 5, further comprising determining a second percentage of the one or more voiced frames in two temporally last continuous voiced frames of the one or more continuous voiced frames, of the first audio segment, with a second cross-correlation greater than a second predefined value.

11. The method according to claim 4, further comprising determining, by the one or more processors, one or more harmonic frequencies of the one or more voiced frames and the one or more unvoiced frames.

12. The method according to claim 11, further comprising determining one or more of a maximum frequency and a minimum frequency among one or more first harmonic frequencies, wherein the one or more first harmonic frequencies are determined from the one or more harmonic frequencies.

13. A system for speech recognition, the system comprising:

a user-computing device comprising a display unit configured to display a classification and a microphone configured to record an audio signal of a voiced conversation;

a database serving comprising a memory configured to store the audio signal received through a communication medium from the user-computing device; and an application server comprising:

a transceiver for wired or wireless communication, the transceiver configured to receive an audio signal of a voiced conversation from the database server through the communication medium and to transmit the classification of a first audio segment to the user-computing device;

a segmentation unit configured to sampling the audio signal to generate a plurality of audio segments of the voiced conversation; and one or more processors configured to:

compute a first spectrogram of the first audio segment of the audio segments based on one or more speech processing techniques, wherein the first audio segment comprises an uninterrupted audio of a user;

divide the first spectrogram of the first audio segment into a plurality of first chunks each having a first predetermined time duration;

apply a first array of band-pass filters to the first chunks to determine first filter outputs;

determine a first variance of the first filter outputs for each of the first chunks of the first spectrogram;

determine a first predetermined percentile of the first variance of the first filter outputs;

identify a second audio segment from the audio segments of the voice conversation, the second audio segment being temporally adjacent the first audio segment;

compute a second spectrogram of the second audio segment;

divide the second spectrogram of the second audio segment into a plurality of second chunks each having a second predetermined time duration;

apply a second array of band-pass filters to the second chunks to determine second filter outputs;

determine a second variance of the second filter outputs for each of the second chunks of the second spectrogram;

determine a second predetermined percentile of the second variance of the second filter outputs;

determine a ratio between the first predetermined percentile of the first variance and the second predetermined percentile of the second variance; and classify the first audio segment either in an interrogative category that corresponds to a question statement or a non-interrogative category that does not correspond to a question statement, based on the ratio between the first predetermined percentile of the first variance associated with the first audio segment and the second predetermined percentile of the second variance associated with the second audio segment.

14. The system according to claim 13, wherein the one or more processors are further configured to identify one or more voiced frames and one or more unvoiced frames from each of the audio segments based on at least a voiced/unvoiced classification technique.

15. The system according to claim 14, wherein the one or more processors are further configured to determine a percentage of the one or more voiced frames in the first audio segment.

16. An application server in a speech recognition system comprising the application server, a user-computing device comprising a display unit and a microphone, a database server comprising a memory configured to store an audio signal of a voiced conversation, and a communication medium linking the application server, user-computing device, and database server, the application server comprising a non-transitory computer readable medium, a transceiver for wired or wireless communication, a segmentation unit, and one or more processors, wherein the non-transitory computer readable medium stores a computer program code executable by the one or more processors to perform a method of speech recognition, the method comprising:

receiving from the database server through the communication medium, by the transceiver, the audio signal of the voiced conversation recorded by the microphone of the user-computing device;

sampling, by a segmentation unit, the audio signal to generate a plurality of audio segments of the voiced conversation;

computing, by the one or more processors, a first spectrogram of a first audio segment of the audio segments based on one or more speech processing techniques, wherein the first audio segment comprises an uninterrupted audio of a user;

dividing, by the one or more processors, the first spectrogram of the first audio segment into a plurality of first chunks each having a first predetermined time duration;

applying, by the one or more processors, a first array of band-pass filters to the first chunks to determine first filter outputs;

determining, by the one or more processors, a first variance of the first filter outputs for each of the first chunks of the first spectrogram;

determining, by the one or more processors, a first predetermined percentile of the first variance of the first filter outputs;

identifying, by the one or more processors, a second audio segment from the audio segments of the voice conversation, the second audio segment being temporally adjacent the first audio segment;

computing, by the one or more processors, a second spectrogram of the second audio segment;

dividing, by the one or more processors, the second spectrogram of the second audio segment into a plurality of second chunks each having a second predetermined time duration;

applying, by the one or more processors, a second array of band-pass filters to the second chunks to determine second filter outputs;

determining, by the one or more processors, a second variance of the second filter outputs for each of the second chunks of the second spectrogram;

determining, by the one or more processors, a second predetermined percentile of the second variance of the second filter outputs;

determining, by the one or more processors, a ratio between the first predetermined percentile of the first variance and the second predetermined percentile of the second variance;

classifying, by the one or more processors, the first audio segment either in an interrogative category that corresponds to a question statement or a non-interrogative category that does not correspond to a question statement, based on the ratio between the first predetermined percentile of the first variance associated with the first audio segment and the second predetermined percentile of the second variance associated with the second audio segment; and transmitting, by the transceiver, the classification of the first audio segment to the user-computing device through the communication medium to be displayed on the display unit.

* * * * *